US009406201B2

(12) United States Patent
Englman et al.

(10) Patent No.: US 9,406,201 B2
(45) Date of Patent: Aug. 2, 2016

(54) PRESENTING GROUP WAGERING GAMES AND AWARDS

(75) Inventors: Allon G. Englman, Chicago, IL (US); Damon E. Gura, Chicago, IL (US); Joel R. Jaffe, Glenview, IL (US); Michael W. Mastropietro, Chicago, IL (US); Jamie W. Vann, Chicago, IL (US); James Palermo, Chicago, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 896 days.

(21) Appl. No.: 13/202,518

(22) PCT Filed: Feb. 22, 2010

(86) PCT No.: PCT/US2010/024957

§ 371 (c)(1),
(2), (4) Date: Aug. 19, 2011

(87) PCT Pub. No.: WO2010/096784

PCT Pub. Date: Aug. 26, 2010

(65) Prior Publication Data

US 2011/0300926 A1 Dec. 8, 2011

Related U.S. Application Data

(60) Provisional application No. 61/154,604, filed on Feb. 23, 2009.

(51) Int. Cl.
*G07F 17/32* (2006.01)

(52) U.S. Cl.
CPC ..... *G07F 17/3274* (2013.01); *G07F 17/3223* (2013.01); *G07F 17/3286* (2013.01)

(58) Field of Classification Search
USPC ..... 463/16, 19, 20, 25, 26, 31
See application file for complete search history.

(56) References Cited

U.S. PATENT DOCUMENTS 6,364,765 B1 * 4/2002 Walker ..... G07F 17/32 273/138.1
6,592,456 B2 7/2003 Walker et al.

(Continued)

FOREIGN PATENT DOCUMENTS

JP 2002315969 10/2002
WO WO2006017068 2/2006

(Continued)

OTHER PUBLICATIONS

"PCT Application No. PCT/US10/24957 International Preliminary Report on Patentability", Mar. 29, 2011 , 16 pages.

(Continued)

*Primary Examiner* — Pierre E Elisca
(74) *Attorney, Agent, or Firm* — DeLizio Law, PLLC

(57) ABSTRACT

A wagering game system and its operations are described herein. In embodiments, the operations can include monitoring wagering game play for a player account that is registered to play a group scavenger hunt game. The group scavenger hunt game may include various collectable items that group members collect to win the group scavenger hunt game. The operations can further include determining that wagering game events occur during the wagering game play, where the occurrences of the wagering game events are prerequisites for obtaining the collectable items. The operations can further include indicating on a group progress report (e.g., a website) that one of the collectable items was obtained. In some embodiments, the operations can also include awarding the player account for obtaining the item, providing trophies, or other virtual assets, for winning the group scavenger hunt game, providing benefits for holding the trophies, etc.

18 Claims, 10 Drawing Sheets

(56) References Cited

U.S. PATENT DOCUMENTS

| | | | | |
|---|---|---|---|---|
| 6,605,001 | B1 | 8/2003 | Tarantino et al. | |
| 6,612,575 | B1 | 9/2003 | Cole et al. | |
| 6,692,353 | B2 | 2/2004 | Walker et al. | |
| 6,800,027 | B2 | 10/2004 | Giobbi et al. | |
| 6,843,724 | B2 | 1/2005 | Walker et al. | |
| 7,182,690 | B2 | 2/2007 | Giobbi et al. | |
| 7,713,119 | B2 | 5/2010 | Pacey et al. | |
| 7,785,194 | B2 | 8/2010 | Schneider et al. | |
| 7,811,167 | B2 | 10/2010 | Giobbi et al. | |
| 2003/0064807 | A1 | 4/2003 | Walker et al. | |
| 2005/0054422 | A1 | 3/2005 | Rothkranz et al. | |
| 2006/0068893 | A1 | 3/2006 | Jaffe et al. | |
| 2006/0205483 | A1* | 9/2006 | Meyer | G06Q 20/06 463/25 |
| 2006/0264257 | A1 | 11/2006 | Jaffe et al. | |
| 2007/0117616 | A1 | 5/2007 | Bartholomew | |
| 2007/0226062 | A1 | 9/2007 | Hughes et al. | |
| 2007/0259713 | A1 | 11/2007 | Fiden et al. | |
| 2008/0026816 | A1* | 1/2008 | Sammon et al. | 463/20 |
| 2008/0200244 | A1 | 8/2008 | Rowe et al. | |
| 2008/0248865 | A1 | 10/2008 | Tedesco et al. | |
| 2008/0293473 | A1 | 11/2008 | Fiden et al. | |
| 2008/0293478 | A1 | 11/2008 | Anderson et al. | |
| 2008/0318671 | A1 | 12/2008 | Rowe et al. | |
| 2009/0011824 | A1 | 1/2009 | Englman et al. | |
| 2009/0036186 | A1 | 2/2009 | Benco et al. | |
| 2009/0054136 | A1 | 2/2009 | Gagner et al. | |
| 2009/0156299 | A1 | 6/2009 | Anderson et al. | |
| 2009/0197684 | A1 | 8/2009 | Arezina et al. | |
| 2010/0004056 | A1* | 1/2010 | Walker et al. | 463/25 |
| 2010/0016063 | A1 | 1/2010 | Jaffe et al. | |
| 2010/0016071 | A1 | 1/2010 | Jaffe et al. | |
| 2010/0046553 | A1* | 2/2010 | Daigle et al. | 370/474 |
| 2010/0056251 | A1 | 3/2010 | Jaffe et al. | |
| 2010/0203963 | A1 | 8/2010 | Allen et al. | |
| 2010/0240442 | A1 | 9/2010 | Anderson et al. | |
| 2010/0255900 | A1 | 10/2010 | Ansari et al. | |
| 2010/0267449 | A1 | 10/2010 | Gagner et al. | |
| 2010/0317424 | A1 | 12/2010 | Hornik et al. | |
| 2011/0021260 | A1 | 1/2011 | Adiraju et al. | |
| 2011/0034237 | A1 | 2/2011 | Schulhof et al. | |
| 2011/0045892 | A1 | 2/2011 | Vann et al. | |
| 2011/0045895 | A1 | 2/2011 | Gagner et al. | |
| 2011/0130197 | A1 | 6/2011 | Bytnar et al. | |
| 2012/0016860 | A1* | 1/2012 | Jones | 707/706 |
| 2012/0080268 | A1* | 4/2012 | Bedell | 182/134 |

FOREIGN PATENT DOCUMENTS

| | | | |
|---|---|---|---|
| WO | WO2006044252 | | 4/2006 |
| WO | WO2007067980 | | 6/2007 |
| WO | WO2007098117 | | 8/2007 |
| WO | WO2007130464 | | 11/2007 |
| WO | WO 2007130464 | A2 * | 11/2007 |
| WO | WO2008060978 | | 5/2008 |
| WO | WO2008116151 | | 9/2008 |
| WO | WO2010045333 | | 4/2010 |
| WO | WO2010096784 | | 8/2010 |
| WO | WO2010105088 | | 9/2010 |
| WO | WO2010151547 | | 12/2010 |

OTHER PUBLICATIONS

"PCT Application No. PCT/US10/24957 International Search Report", May 17, 2010 , 10 pages.

* cited by examiner

PRESENTING GROUP WAGERING GAMES AND AWARDS

RELATED APPLICATIONS

This application claims the priority benefit of U.S. Provisional Application Ser. No. 61/154,604 filed Feb. 23, 2009.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2010, WMS Gaming, Inc.

TECHNICAL FIELD

Embodiments of the inventive subject matter relate generally to wagering game systems and networks that, more particularly, present group wagering games and awards.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play. Further, wagering games are expanding in popularity. Many wagering game enthusiasts are demanding greater access to wagering games and content related to wagering games. As a result, some wagering game companies have created online wagering game websites that provide a way for wagering game enthusiasts to play wagering games while connected to the Internet (e.g., via a web-browser). Therefore, there is also a continuing need for online game providers to continuously develop new games and gaming enhancements that will attract frequent play, increase online gaming revenue, etc.

SUMMARY

In some embodiments, a method comprises registering a player account as a group member to compete in a group scavenger hunt game; determining that the player account is playing a wagering game during a wagering game session; determining a scavenger hunt collectable item in the group scavenger hunt game that has not been obtained; determining a wagering game event associated with the scavenger hunt collectable item; monitoring wagering game play by the player account for one or more wagering games; determining that the wagering game event occurs during the wagering game play; awarding the scavenger hunt collectable item as a group achievement for the group scavenger hunt game; and indicating the scavenger hunt collectable item on an online group-scavenger-hunt progress report.

In some embodiments, indicating the scavenger hunt collectable item on the online group-scavenger-hunt progress report further comprises identifying the player account that obtained the scavenger hunt collectable item.

In some embodiments, the online group-scavenger-hunt progress report is a themed website that presents a plurality of collectable game goal items in a progressing order.

In some embodiments, the method further comprises providing an award associated with the scavenger hunt collectable item to the player account; and indicating the award on the online group-scavenger-hunt progress report.

In some embodiments, the method further comprises determining that the scavenger hunt collectable item is a final collectable item of a plurality of collectable items associated with an objective of the group scavenger hunt game; and awarding one or more possession rights in a virtual trophy to one or more of the player account and one or more additional group member player accounts.

In some embodiments, the method further comprises placing an instance of the virtual trophy in a display associated with the player account; and assigning one or more wagering game benefits to the one or more possession rights.

In some embodiments, determining that the wagering game event occurs during the wagering game play comprises determining that the group scavenger hunt game requires the wagering game event be repeated a multiple number of times by one or more of the player account and any other group member before indicating that the scavenger hunt collectable item was obtained.

In some embodiments, indicating the scavenger hunt collectable item on the online group-scavenger-hunt progress report comprises, providing to the player account a representative item object associated with the group scavenger hunt collectable item, and providing controls for the player account to place the representative item within the online group-scavenger-hunt progress report.

In some embodiments, one or more machine-readable media having instructions stored thereon, which when executed by a set of one or more processors causes the set of one or more processors to perform operations comprises determining a player account that is playing a wagering game; determining that the player account holds a possession right in a virtual trophy the player account earned from winning a group game; determining a benefit associated with holding the possession right, wherein the benefit includes a performance enhancement value that can be utilized, during the wagering game, to improve performance of a game function; determining a programmatic game element associated with the game function; utilizing the performance enhancement value in association with the programmatic game element; and improving the performance of the game function based on the performance enhancement value.

In some embodiments, said operation of improving the performance of the game function based on the performance enhancement value further comprises one or more of improving a chance that a favorable wagering game event occurs in the wagering game, providing a score multiplier enhancer in a bonus game, providing a bet enhancer, increasing skill-based performance, and providing a payout.

In some embodiments, the operations further comprise determining a time period associated with holding the possession right; determining that the time period has expired; and deactivating the possession right.

In some embodiments, the operations further comprise receiving a request to transfer the possession right to an additional player account for a form of compensation; receiving an indication that the form of compensation was provided to the player account; and transferring the possession right to the additional player account.

In some embodiments, a system comprises a wagering game server comprises an event controller configured to determine one or more events to assign to items in a group scavenger hunt game, and track completion of the one or more events by group members registered for the group scavenger hunt game. The system can also include an item controller configured to determine one or more representative item objects in the group scavenger hunt game that is associated with completed events, associate the one or more representative item objects with one or more player accounts that accomplished the completed events, and present the one or more representative item objects on an online group-scavenger-hunt progress report. The system can also include and an award controller configured to provide one or more awards to the one or more player accounts that accomplished the completed events. The system can also include a client device configured to access the one or more player accounts, and control one or more of the one or more representative item objects and the one or more awards.

In some embodiments, the award controller is further configured to distribute the one or more awards according to factors including one or more of a number of times an event is accomplished, a percentage of events accomplished by the group members, a number of group members, and milestones achieved by the group members.

In some embodiments, the award controller is further configured to provide awards that escalate in value as more of the items are obtained for the group scavenger hunt game.

In some embodiments, the item controller is further configured to transfer the one or more representative item objects to an additional group-scavenger-hunt progress report, determine one or more additional representative item objects on the additional group-scavenger-hunt progress report that are equivalent in value to the one or more representative item objects, and indicate on the additional group-scavenger-hunt progress report that the one or more additional representative item objects were obtained.

In some embodiments, the item controller is further configured to calculate a first value for the one or more representative item objects in the group scavenger hunt game, compare the first value to a second value for the one or more additional representative item objects in an additional group scavenger hunt game, and determine that the first value and the second value are equivalent.

In some embodiments, an apparatus comprises a group scavenger hunt item controller configured to determine a player account that is registered as a group member for one or more group scavenger hunt games, determine a request to substitute one or more unobtained scavenger hunt items from the one or more group scavenger hunt games with one or more obtained first scavenger items from the one or more group scavenger hunt games, determine that a first value for the one or more unobtained scavenger hunt items is equivalent to a second value for the one or more obtained first scavenger items, and substitute the one or more unobtained scavenger hunt items with the one or more obtained first scavenger items.

In some embodiments, the group scavenger hunt item controller is further configured to determine one or more wagering game events associated with the unobtained scavenger hunt items, and indicate on a group-scavenger-hunt progress report that the one or more wagering game events were accomplished.

In some embodiments, the group scavenger hunt item controller is further configured to determine one or more first wagering game events associated with the obtained scavenger hunt items, determine one or more first odds for obtaining the one or more first wagering game events, determine one or more second wagering game events associated with the unobtained scavenger hunt items, determine one or more second odds for obtaining the one or more second wagering game events, determine that the one or more first odds and the one or more second odds are equivalent, and present the one or more unobtained scavenger hunt items to the player account to select one or more as substitutes for one or more of the one or more obtained scavenger hunt items.

In some embodiments, the group scavenger hunt item controller is configured to determine one or more of odds for obtaining an event, values of awards associated with an event, and one or more payments made by the player account.

In some embodiments, an apparatus comprises means for determining that a player account is playing a wagering game during a wagering game session, wherein the player account is registered as one of a plurality of group members of a group scavenger hunt game; means for determining a scavenger hunt item in the group scavenger hunt game that has not been obtained; means for determining a wagering game event associated with the scavenger hunt item; means for monitoring wagering game play by the player account for one or more wagering games played by one or more of the player account and the plurality of group members; means for determining that to obtain the scavenger hunt item, the group scavenger hunt game requires the wagering game event to be repeated a multiple number of times by any one or more of the player account and the plurality of group members; means for determining that the wagering game event occurs during the wagering game play; and means for indicating an occurrence of the wagering game event on a group scavenger hunt webpage in association with the scavenger hunt item on the group scavenger hunt webpage.

In some embodiments, the means for indicating the occurrence of the wagering game event comprises, means for indicating the occurrence on a counter associated with the scavenger hunt item, wherein the counter includes information about the player account that accomplished the wagering game event.

In some embodiments, an apparatus further comprises means for determining that the occurrence of the wagering game event is a final occurrence required to obtain the group scavenger hunt item; means for awarding the scavenger hunt item as a group achievement for the group scavenger hunt game; and means for indicating the scavenger hunt item on the group scavenger hunt website.

In some embodiments, the apparatus further comprises means for providing at least some portion of an award associated with the scavenger hunt item to the player account based on a number of times that the wagering game event occurred to the player account.

BRIEF DESCRIPTION OF THE DRAWING(S)

Embodiments are illustrated in the FIGS. of the accompanying drawings in which.

DESCRIPTION OF ILLUSTRATIVE EMBODIMENTS

This description of the embodiments is divided into five sections. The first section provides an introduction to embodiments. The second section describes example operating environments while the third section describes example operations performed by some embodiments. The fourth section describes additional example operating environments while the fifth section presents some general comments.

Introduction

This section provides an introduction to some embodiments.

Casinos, game manufacturers, online game providers, etc., are always interested in new and innovative ways to make wagering games more interesting. A more interesting wagering game provides greater entertainment value and leads to increased profits on wagering games. Presented herein are some embodiments of providing group games in a networked wagering game environment. One example is a group scavenger hunt game. In some embodiments, players can compete against each other to collect game items (e.g., scavenger hunt game collectable items, game goal items, etc.) for the group scavenger hunt game by accomplishing wagering game events. The group scavenger hunt game provides awards and trophies, which can provide various game benefits, rights, dynamic properties, etc. In some embodiments, the group scavenger hunt game can include an online tracking system, or progress report, of items that have been obtained by group members. Some embodiments can provide ways of substituting, or exchanging, items of equivalent values in different scenarios. Some embodiments describe examples of controlling possession rights and benefits associated with trophies for group wagering games, and so forth.

In some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as controlling (e.g., obtaining, referencing, exchanging, etc.) an item, or accomplishing an event. Although a player, or person, may be activating a game control or device to control the item or accomplish the event, the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling".

Figure 1:
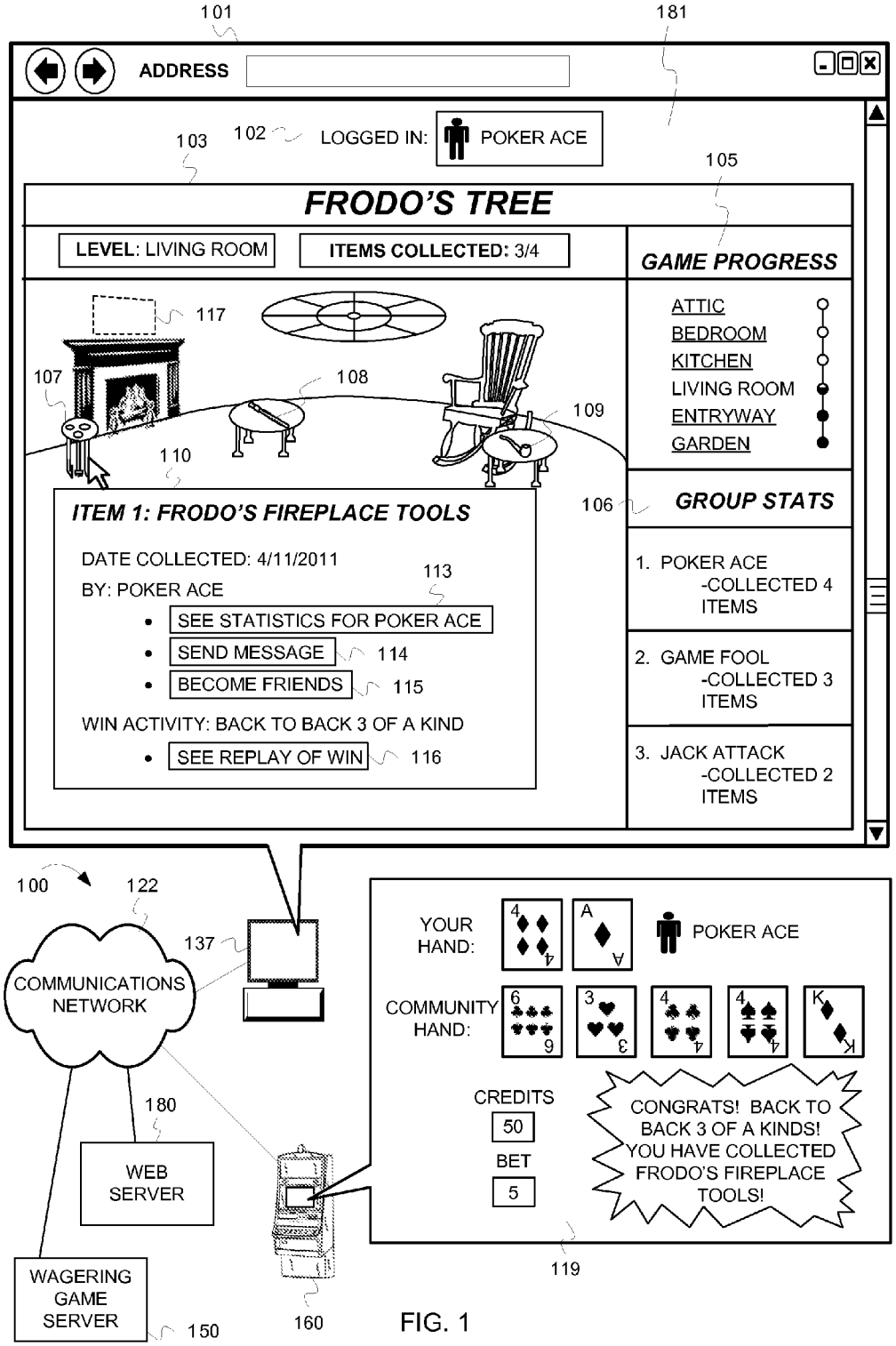
FIG. 1 is an illustration of presenting a group scavenger hunt game webpage, according to some embodiments.

FIG. 1 is a conceptual diagram that illustrates an example of presenting a group scavenger hunt game webpage, according to some embodiments. In FIG. 1, a wagering game system ("system") 100 includes a wagering game server 150 connected to one or more client devices, such as a wagering game machine 160 or a computer 137, via a communications network 122. The wagering game server 150 can also be connected to a web server 180 that hosts a website. The computer 137 can be situated anywhere (e.g., at home, in a place of business, in a casino, etc.) and can be utilized to present a web browser 101 (or any other network-browsing capable application). The web server 180 can provide content that the web browser 101 can present in the form of a webpage 181. The webpage 181 can include player account information 102 for a player account that is logged on to a player network. The player network can be hosted by the web server 180, the wagering game server 150, and/or other servers not shown (e.g., a community server, an account server, etc.). The player account information 102 can include identifiers, such as a player account's handle, avatar, etc. The webpage 181 can include an online group-scavenger-hunt progress report ("progress report") 103. The progress report 103 can be a themed presentation, which group members of the group scavenger hunt game, and others, can visit via the Internet. A purpose of the progress report 103 can be to show various items (e.g., fireplace tools 107, flute 108, and pipe 109) that group members have collected for the group scavenger hunt game. The system 100 can present the items in a specific order, en route to an overall prize, like a trophy. In some embodiments, the progress report 103 may also be referred to herein as a "trophy case" as it represents a visible platform for player accounts to see and admire the efforts of the group. The progress report 103 can show many different items by having multiple containers/rooms/etc. For example, the progress report 103 can be themed (e.g., Frodo Baggins' Tree), and each themed room can shows different themed items that fit the theme of the room (e.g., the fireplace tools 107, the flute 108, and the pipe 109 are all items that may appear in Frodo's living room). The items may be collected, or obtained, while a player plays, or participates, in any wagering game (e.g., a poker game 119) or similar wagering activity available within a casino network, an online wagering website, or any other gaming venue. The progress report 103 can also show any events that needed to be performed to obtain the item. For example, a player can position a mouse pointer over an item (e.g., the fireplace tools 107) and a rollover graphic 110 may appear, which shows information on what the event was that obtained the item. The rollover graphic 110 can also present other information associated with the event and/or the player account, including a date when the event occurred, player account information for who performed the event, statistics for the player account associated with the event (e.g., statistics control button 113 to view Poker Ace's statistics), communications controls (e.g., chat control button 114), social networking controls (e.g., friend request control button 115), replay controls (e.g., replay control button 116 to replay the event), etc. The progress report 103 can also show any events that need to be accomplished for items not yet obtained (e.g., see FIG. 4 which describes details about a missing item—Frodo's missing painting 117). The progress report 103 can also present a game progress meter 105 that tracks the progress of the group scavenger hunt game. Multiple group scavenger hunt members can share the progress report 103. The system 100 can present group statistics 106 that relate to the group members' achievements. Each group member's achievements (e.g., obtaining an item) can contribute overall as a group achievement in that everyone who shares the progress report 103 benefits from each member's achievements. Specifically, when one group member obtains an item, it can count as one step closer to the trophy for the entire group. When all of the items are obtained, then the system can award the trophy, and any award that goes along with the trophy, to the group as a whole, or to any one or more members of the group (e.g., split evenly amongst the group, divided proportionately to group members according to performance in the group scavenger hunt game, provided randomly to one of the group members, etc.). In some embodiments, the system 100 can auction the trophy and/or awards to group members. The group members who receive the trophy, or a share of the trophy, receive possession rights, or a share of possession rights (e.g., an interest, a claim, a share, a stake, an entitlement, a privilege, etc.) to the trophy. The system can provide benefits associated with the possession rights and associate those benefits with the player accounts for the group members. The system 100 can access those benefits and apply them to wagering games to enhance the player's performance and/or chances of winning during the wagering game. Thus, if a player account plays a wagering game, the system 100 can determine that the player account holds a possession right to a trophy and access values associated with the benefit that can modify game play (e.g., that can pass as parameters into subroutines and other programming for the wagering games) to improve a player's performance. The benefits can also be associated with marketing offers (e.g., discounts for merchandise, discounts on casino entertainment, etc.).

Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 2:
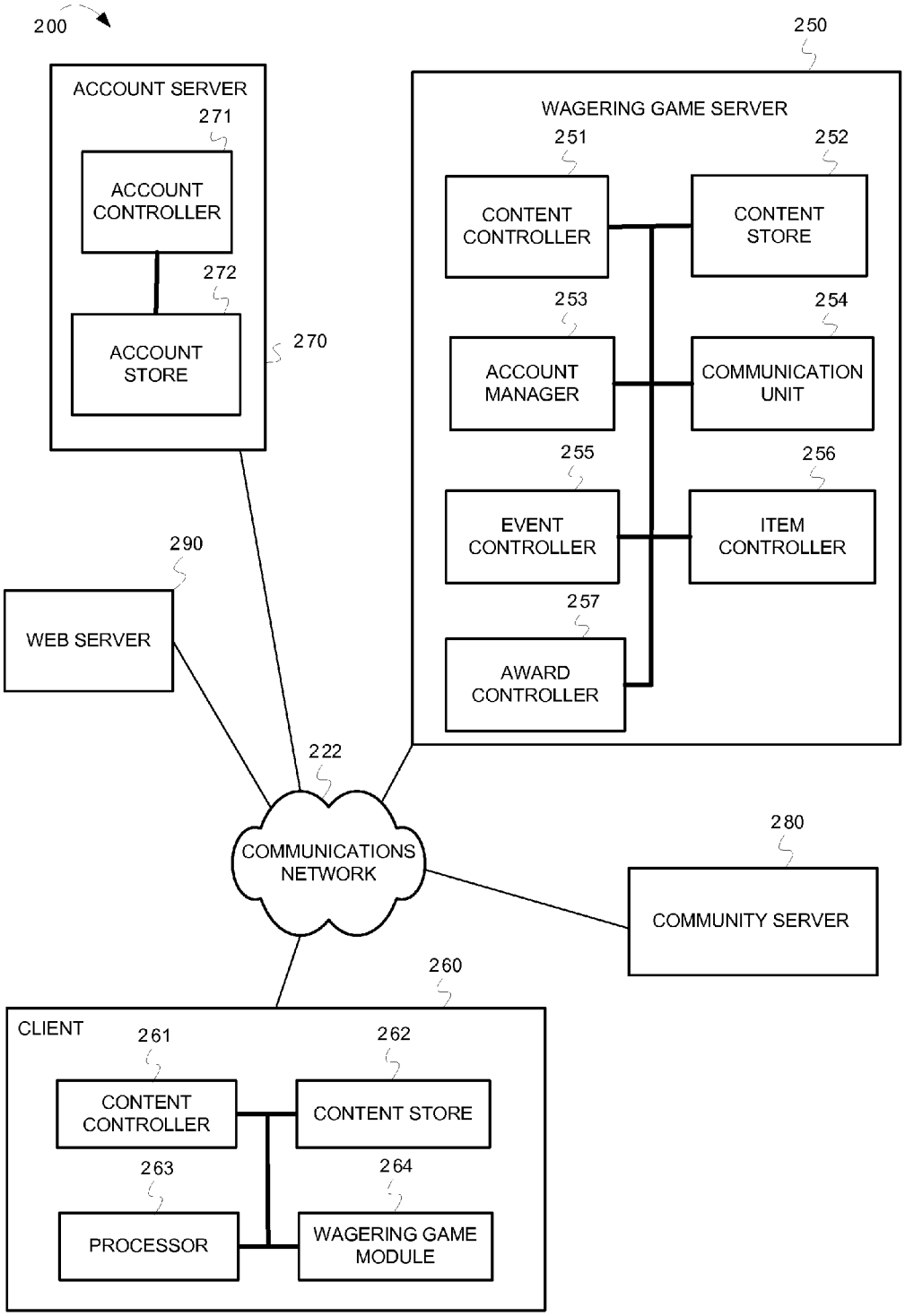
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include an account server 270 configured to control user related accounts accessible via wagering game networks and social networks. The account server 270 can store and track player information, such as identifying information (e.g., avatars, screen name, account identification numbers, etc.) or other information like financial account information, social contact information, etc. The account server 270 can contain accounts for social contacts referenced by the player account. The account server 270 can also provide auditing capabilities, according to regulatory rules, and track the performance of players, machines, and servers. The account server 270 can include an account controller 271 configured to control information for a player's account. The account server 270 can also include an account store 272 configured to store information, settings, preferences, etc. for a player's account, group scavenger hunt game membership, scavenger hunt game progress, collected scavenger hunt items, item exchanges, trophy possession rights, trophy benefits, etc.

The wagering game system architecture 200 can also include a wagering game server 250 configured to present wagering games and receive and transmit information to present group games and awards. The wagering game server 250 can include a content controller 251 configured to manage and control content for the presentation of content on a client device ("client") 260. For example, the content controller 251 can generate game results (e.g., win/loss values), including win amounts, for games played on the client 260. The content controller 251 can communicate the game results to the client 260. The content controller 251 can also generate random numbers and provide them to the client 260 so that the client 260 can generate game results. The wagering game server 250 can also include a content store 252 configured to contain content to present on the client 260. The wagering game server 250 can also include an account manager 253 configured to control information related to player accounts. For example, the account manager 253 can communicate wager amounts, game results amounts (e.g., win amounts), bonus game amounts, etc., to the account server 270. The wagering game server 250 can also include a communication unit 254 configured to communicate information to the client 260 and to communicate with other systems, devices and networks. The wagering game server 250 can also include an event controller 255 configured to determine one or more events to assign to items in a group scavenger hunt game. The event controller 255 can also be configured to track the completion of the events by group members registered for a group scavenger hunt game. The wagering game server 250 can also include an item controller 256 configured to determine representative item objects in a group scavenger hunt game that are associated with completed events and associate the representative item objects with player accounts that accomplished the events. The item controller 256 can also be configured to exchange items between group games for other items associated with events with equivalent values. The item controller 256 can also facilitate the exchange, sale, trade, etc. of representative item objects. The wagering game server 250 can also include an award controller 257 configured to determine awards to assign to items, milestones, trophies, and other accomplishments associated with a group scavenger hunt game. The award controller 257 can also be configured to distribute awards according to various factors such as a number of times an event is accomplished, a percentage of events accomplished by group members, a number of group members, specific accomplishments completed by individual group members, etc. The award controller 257 can also be configured to track and control possession rights, dynamic characteristics, and benefits associated with trophies that are held by player accounts.

The wagering game system architecture 200 can also include the client 260 configured to present wagering games and receive and transmit information to present group wagering games and awards. The client 260 can be a computer system, a personal digital assistant (PDA), a cell phone, a laptop, a wagering game machine, or any other device or machine that is capable of processing information, instructions, or other data provided via a communications network 222. The client 260 can include a content controller 261 configured to manage and control content and presentation of content on the client 260. The client 260 can also include a content store 262 configured to contain content to present on the client 260. The client 260 can also include a processor 263 configured to process wagering game content, present online wagering game objects, control gaming devices, etc. The client 260 can also include a wagering game module 264 configured to control presentation of group games, control communication between group game players, control tracking of events in the group games, control association of items and awards from the group games, etc.

The wagering game system architecture 200 can also include a web server 290 configured to control and present an online website that hosts wagering games and other wagering activity.

The wagering game system architecture 200 can also include a community server 280 configured to control social network interactivity, features, and functionality for a wagering game social network, or other social networks, integrated with a casino network, an online wagering website, or any other network wagering venue. The community server 280 can also be configured to store accounts related to social networks. Via the communications network 222, the community server 280 can access a casino account stored on the account server 270, and vice-versa. For example, the community account owner can login to the community server 280 and access the account server 270 to set user preferences. Further, the community server 280 can be configured to provide social contact account information for use in group scavenger hunt games. For example, the account server 270 can determine player account information for social contact accounts, from the community server 280, that are associated with player accounts on the account server 270. The player accounts can be registered to play group scavenger hunt games. The account server 270 can determine whether those social contact accounts have player accounts on the account server 270. If so, the account server 270 can then communicate player account information to the wagering game server 250 to register the player accounts for group scavenger hunt games.

Each component shown in the wagering game system architecture 200 is shown as a separate and distinct element connected via the communications network 222. However, some functions performed by one component could be performed by other components. For example, the wagering game server 250 can also be configured to perform functions of the content controller 261, the content store 262, the processor 263, the wagering game module 264, and other network elements and/or system devices. Furthermore, the components shown may all be contained in one device, but some, or all, may be included in, or performed by multiple devices, as in the configurations shown in FIG. 2 or other configurations not shown. For example, the account manager 253 and the communication unit 254 can be included in the client 260 instead of, or in addition to, being a part of the wagering game server 250. Further, in some embodiments, the client 260 can determine wagering game outcomes, generate random numbers, etc. instead of, or in addition to, the wagering game server 250.

In some embodiments, the client 260 is a wagering game machine. Wagering game machines described herein can take any suitable form, such as floor standing models, handheld mobile units, bar-top models, workstation-type console models, surface computing machines, etc. Further, the wagering game machines can be primarily dedicated for use in conducting wagering games, or can include non-dedicated devices, such as mobile phones, personal digital assistants, personal computers, etc.

In some embodiments, wagering game machines and wagering game servers work together such that wagering game machines can be operated as a thin, thick, or intermediate client. For example, one or more elements of game play may be controlled by the wagering game machines (client) or the wagering game servers (server). Game play elements can include executable game code, lookup tables, configuration files, game outcome, audio or visual representations of the game, game assets or the like. In a thin-client example, the wagering game server can perform functions such as determining game outcome or managing assets, while the wagering game machines can present a graphical representation of such outcome or asset modification to the user (e.g., player). In a thick-client example, the wagering game machines can determine game outcomes and communicate the outcomes to the wagering game server for recording or managing a player's account.

In some embodiments, either the wagering game machines (client) or the wagering game server(s) can provide functionality that is not directly related to game play. For example, account transactions and account rules may be managed centrally (e.g., by the wagering game server(s)) or locally (e.g., by the wagering game machines). Other functionality not directly related to game play may include power management, presentation of advertising, software or firmware updates, system quality or security checks, etc.

Furthermore, the wagering game system architecture 200 can be implemented as software, hardware, any combination thereof, or other forms of embodiments not listed. For example, any of the network components (e.g., the wagering game machines, servers, etc.) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
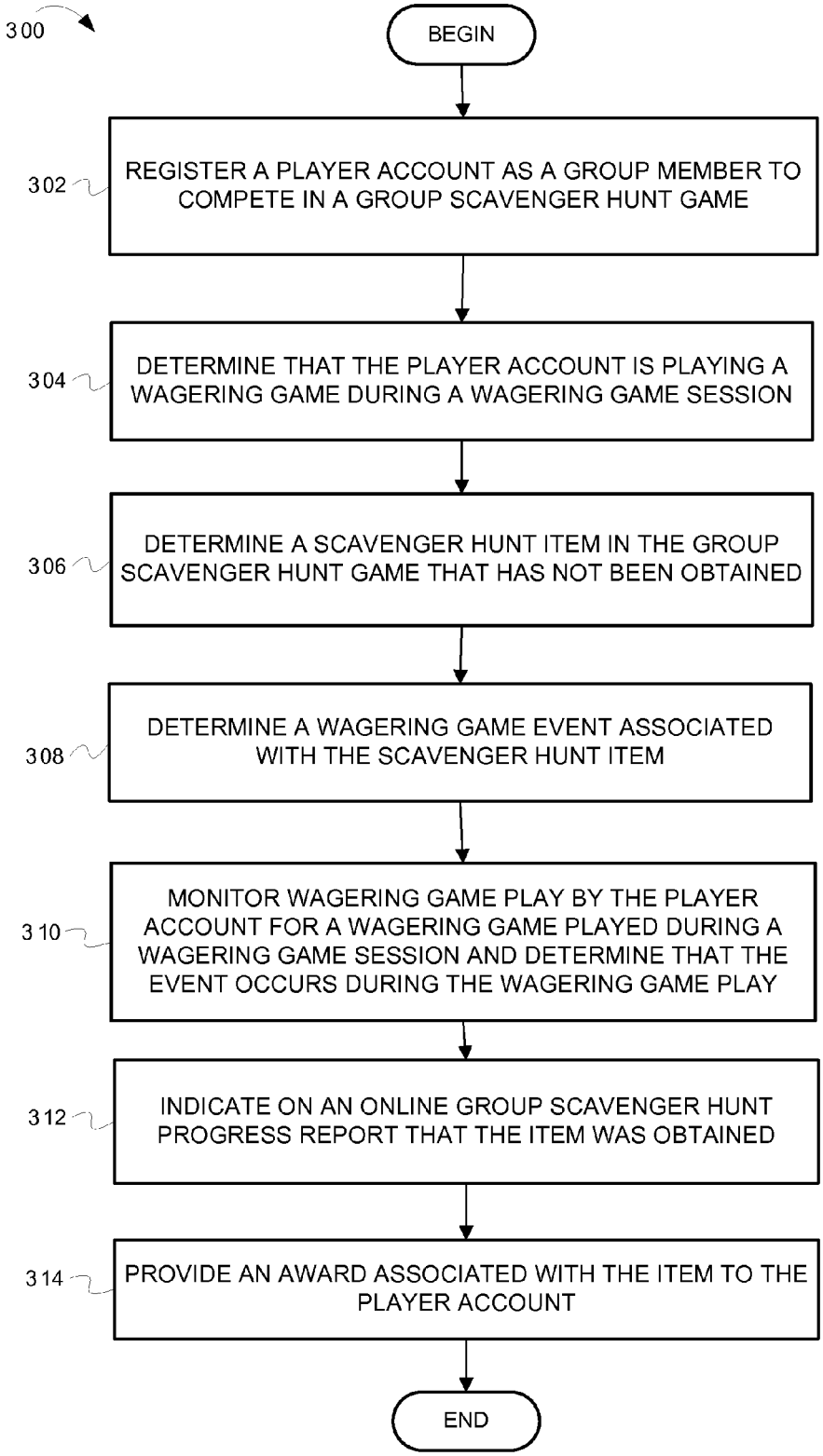
FIG. 3 is a flow diagram 300 illustrating determining wagering game events and assigning associated items for a group scavenger hunt game, according to some embodiments.
Figure 4:
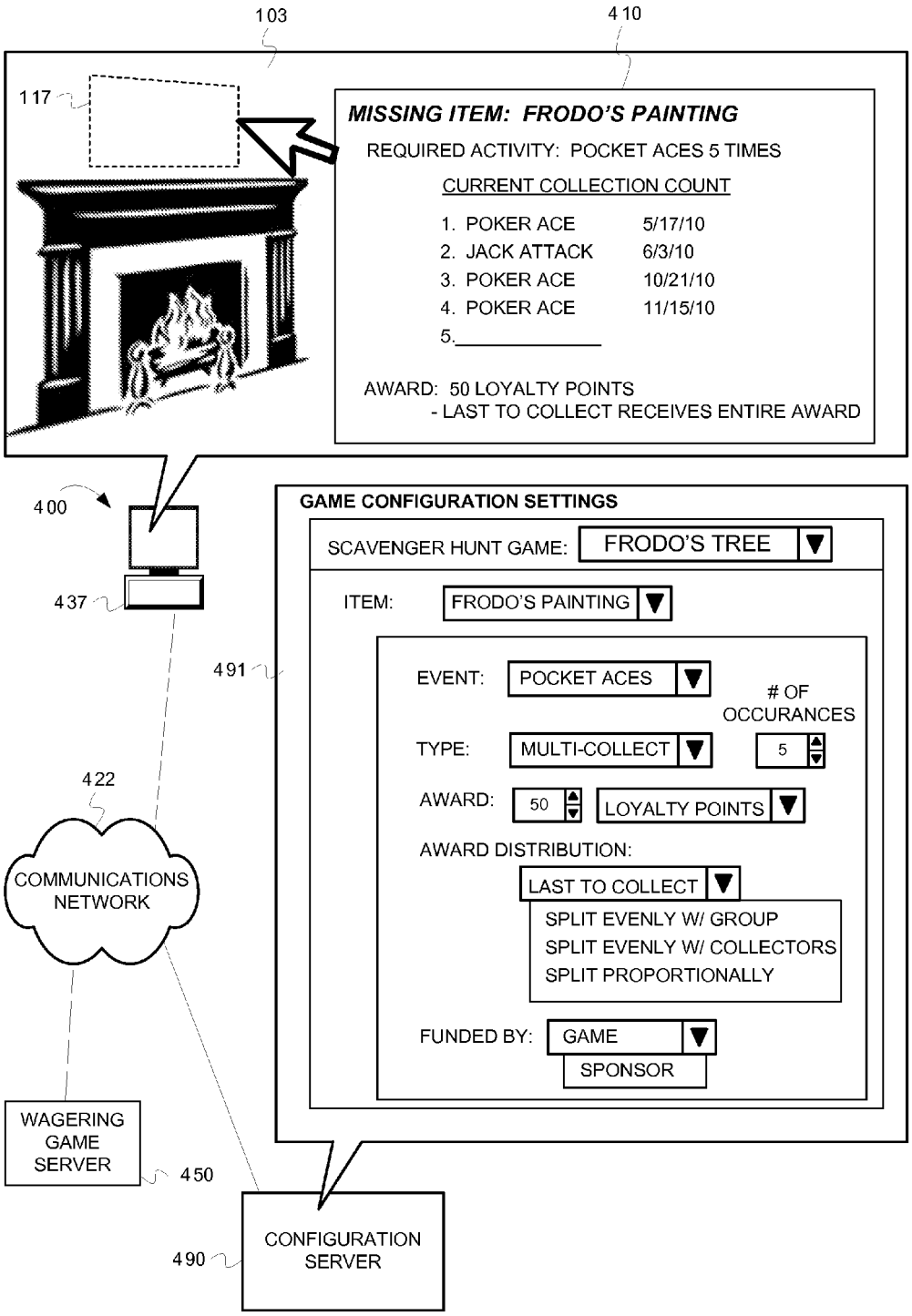
FIG. 4 is an illustration of configuring events, items, and awards associated with a group scavenger hunt game, according to some embodiments.

FIG. 3 is a flow diagram ("flow") 300 illustrating determining wagering game events and assigning associated items for a group scavenger hunt game, according to some embodiments. FIGS. 1, 4, and 7 are conceptual diagrams that help illustrate the flow of FIG. 3, according to some embodiments. This description will present FIG. 3 in concert with FIGS. 1, 4 and 7. In FIG. 3, the flow 300 begins at processing block 302, where a wagering game system ("system") registers a player account as a group member to compete in a group scavenger hunt game. The system can present a themed scavenger hunt game. The scavenger hunt game can be a group game, where a group of player accounts join together to form a scavenger hunt group. In some embodiments, the system can facilitate creating groups by connecting player accounts and presenting controls where players can form a group amongst their friends, family, or other social contacts listed in the player account. FIG. 7 illustrates an example of a wagering game system ("system") 700 including an account server 770 connected to a computer system 737 via a communications network 722. The computer system 737 can present a player account 702 that lists group members 743 for a group, or team, that can compete in a group scavenger hunt game. The system 700 can present one or more social contact selection controls (e.g., team member selector dropdown 744, team member addition button 745, team member removal button 747 etc.) on the player account 702 so that a group member (e.g., Poker Ace) can add, select, and remove the group members 743. The system 700 can also present group identifier controls (e.g., a team name input control 746, a group symbol editor/generator, etc.) so that the player account 702 can assign unique identifiers to the group (e.g., group names, group avatars, group graphics, group colors, group branding, etc.). FIG. 7 will be referred to later in connection with FIG. 6. Returning now to FIG. 3, in some embodiments, the group members do not have to know each other, and the system can generate the groups automatically, suggest players that have common interests, fill in group member minimums with additional player accounts, etc. In other embodiment, the system can register player accounts to compete against each other individually (instead of as a group). In some embodiments, the system can provide a group-scavenger-hunt progress report (e.g., the progress report 103 in FIG. 1). The system can present the group-scavenger-hunt progress report ("progress report") as any presentable (e.g., visual, audible, textual, etc.) representation of a group of scavenger hunt items. The system can present the progress report in one of many forms, such as a chart, a list, an image map, a website, a checklist, a shared account, a database record, a file, etc. The progress report can present items and trophies, when obtained by the group members, throughout the course of the group scavenger hunt game. The items, as described below, are used to track accomplishments by the group members during the group scavenger hunt game. The system lists the items on the progress report. The system can organize (e.g., segregate) the items under milestones. The system can provide awards and recognition for obtaining items and milestones. The system can list the items in a progressing order (e.g., ascending in value or difficulty) or in other organized ways (e.g., grouped by game type, grouped by game theme, grouped by item type, etc.). The items and/or milestones are finite in number and can culminate in obtaining an ultimate objective, or game goal, which can indicate that the group has won the group scavenger hunt game. The ultimate goal can be associated with a virtual asset, like a virtual trophy ("trophy"). The system can award the trophy when all of the items and/or milestones have been obtained in the group scavenger hunt game. In some embodiments, the system can provide trophies for various sub-objectives of the game (i.e., for one or more objectives of the group scavenger hunt game) instead of, or in addition to, an ultimate game goal trophy. The system can present the trophy, or trophies, on the progress report for group members, and others, to view. Consequently, in some embodiments, the progress report may also be referred to as a virtual trophy case ("trophy case"). In some embodiments, where individuals compete against each other in the group scavenger hunt game (instead of groups competing against each other), each individual can have a separate progression chart. The system, however, can present all individuals progress reports to all other registrants of the group scavenger hunt game so that all individuals can check on each other's progress. In some embodiments, the system can place an instance of the trophy in a personal trophy case for any of the group members who helped to attain the trophy. The personal trophy case can persist with player accounts associated with the winning group members.

The flow 300 continues at processing block 304, where the system determines that the player account is playing a wagering game during a wagering game session. For example, in FIG. 1*a* player account can be logged on to the wagering game machine 160 and playing a wagering game (e.g., the poker game 119). The poker game 119 is only one example of a wagering game. Other types of wagering games may include video slots, electronic table games, bingo, etc. The event may also occur during other computerized gambling activity, such as computerized sports betting or fixed-odd betting (e.g., political wagering).

The flow 300 continues at processing block 306, where the system determines a scavenger hunt item in the group scavenger hunt game that has not been obtained. The system can access a progression chart for one or more group scavenger hunt games associated with the player account. For example, when a player logs on to a wagering game session, the system can access the player account and determine whether the player is registered to participate in any current group scavenger hunt games. If the system finds any registered group scavenger hunt games, the system can look through the progress report and determine all items that have already been obtained for any of the group scavenger hunt games as well as any items that have yet to be obtained. In some embodiments, the system can determine that only one item per group game can be obtained according to a sequence. For example, the system can determine whether the group game's rules allow any item to be obtained at any time or if the game requires the items to be found one at a time, in a specific order or sequence. When the system determines what unobtained items still need to be found for the group scavenger hunt games, the system can store a list of those items, and any events associated with those items (see processing block 308) to reference during the wagering game session as the player plays. In some embodiments, the system can determine a virtual asset, or representative item object, associated the scavenger hunt item. For example, the system can determine whether a graphic, a sound, a video, or other object is associated with any of the items to be stored. For instance, in FIG. 1 several of the items include associated objects that represent the items (e.g., a graphic of a flute is associated with Frodo's flute 108, a graphic of fireplace tools is associated with Frodo's fireplace tools 107, an image of a pipe is associated with Frodo's pipe 109). Some items, which have yet to be obtained, may reference an object that is stored on the system, but not yet presented on the progress report (e.g., stored in a database, referenced via metadata, etc.). If there is no virtual asset or object associated with the item, the system can assign an asset or object. In some embodiments, the system can refer to a player's personal account, or a section that is shared by the group, to determine preferred themes, files, graphics, videos, avatars, etc. that the player and/or group likes or has specified to be associated with group items. The system can associate any of those preferred items with the representative item object (e.g., associate a player's avatar with the Frodo's flute object thus identifying the player as the individual who one who obtained the flute object). The system can utilize various types of virtual assets in various different embodiments (for examples of embodiments, see the Virtual Assets section further below).

The flow 300 continues at processing block 308, where the system determines a wagering game event associated with the scavenger hunt item. For example, in FIG. 1, the system 100 can determine that an event occurs during the poker game 119. The event can be associated with the group scavenger hunt game. For example, the system can determine, via the progression chart 103, game rules, a player account, a configuration file, a database record, or any other information associated with the group scavenger hunt game(s), any wagering game event(s) that are associated with the scavenger hunt item. The event can be a requirement for obtaining an item within the scavenger hunt game. In some embodiments, the system can determine whether the event can be obtained by group play. The group scavenger hunt game can have events that are based on group play. For example, the event may be that, to obtain an item, a player has to hit two five-of-a-kind hands in Poker. However, if the group scavenger hunt game allows for group play on a single event, then instead of a player having to hit two five-of-a-kind hands, the requirement could instead permit two separate group members to hit the two five-of-a-kind hands. The system can put restrictions on the group player requirements to make the events more difficult to obtain, such as requiring that the two five-of-a-kind hands need to be obtained while the group members are logged on at the same time, or within a specific time period (e.g., within a two-month period of each other). In some embodiments, the system can incorporate events that are part of game play for a wagering game into the group scavenger hunt game. For example, the system can determine that the events are associated with the group scavenger hunt game as a requirement for obtaining the item, but that have no specific significance to the wagering game that the player is playing. For instance, an example of an event that has no specific significance to the wagering game is where a player may be playing a wagering game of Poker and may hit back-to-back three-of-a-kind hands. The wagering game of Poker, itself, may provide no reward or have any other programming that considers back-to-back three-of-a-kind hands to be significant according to the Poker game's rules, pay tables, etc. Yet, for the group scavenger hunt game, the back-to-back three-of-a-kind hands are required to obtain a scavenger hunt item. On the other hand, the requirement to obtain the scavenger hunt game may be tied to a significant event in the wagering game that the wagering game itself considers part of the game play for the game that the player is playing. For example, the game of Poker may provide a reward for hitting a royal flush. At the same time, the group scavenger hunt game may also require the royal flush to be a required event needed to obtain a scavenger hunt item. Another example is a slot game, where the pay table for the slot game considers a series or configuration of game play elements (e.g., three cherries in a row) to be a payable slot game event. At the same time, a group scavenger hunt game may also require that series or configuration of play elements (e.g., the three cherries) to be a required event for obtaining a scavenger hunt item. The system, therefore, can in some embodiments, tie the significant game events into the group scavenger hunt game. For example, the system can generate group scavenger hunt events by researching the player's, or group members', playing history and, based on games that the player(s) usually play (or don't play), utilize significant events from those games as the group scavenger hunt item events.

The flow 300 continues at processing block 310, where the system monitors wagering game play by the player account for a wagering game played during a wagering game session and determines that the event occurs during the wagering game play. The system can have an agent or service associated with the wagering game (e.g., on a wagering game machine, on the network, etc.), that watches the wagering game play to determine whether events for the group scavenger hunt game occur. If, and when, the event occurs (e.g., is triggered, is performed, is achieved, etc.) the system references game rules and/or history for the group scavenger hunt game. The game rules and/or history indicate whether the event has already occurred and been recorded for the group scavenger hunt game. In some embodiments, if the event occurs, depending on variations of the group scavenger hunt game, the system may or may not recognize the player or present an award or item. For example, the system can determine that the group scavenger hunt game requires the wagering game event be repeated multiple times by one or more of the player account and any other group member before indicating that the item was obtained. In some embodiments, the system, according to group scavenger hunt game rules, can track whether the event has occurred a number of times to one or more of the group members. FIG. 4 illustrates an example of an item (e.g., Frodo's missing painting 117) that requires multiple occurrences of an event. In FIG. 4, a wagering game system ("system") 400 includes a computer 437 connected to a wagering game server 450 via a communications network 422. The computer 437 presents an instance of the progress report 103 of FIG. 1, including an instance of the missing item, Frodo's missing painting ("missing painting") 117. The missing painting 117 can present a display 410 indicating information associated with the missing painting 117. Some of the information can include the name of the missing item, an event (e.g., "activity") that is required to obtain the item (e.g., five occurrences of pocket aces), a counter of the number of occurrences, and any award associated with obtaining the item. The display 410 can recognize a player each time the event occurs (e.g., each time the player account receives pocket aces in a video poker game). Depending on the awards settings, the system 400 can award one or more of the players that accomplished the event. In some embodiments, the system 400 can provide one of the players with a representative item object associated with the missing item (e.g., reward the fifth player to get pocket aces with Frodo's painting). The system can present a congratulatory presentation indicating that the player obtained the item. During the congratulatory presentation, the system can present a display of the representative item object so that the player can place the object in the progress report 103. In some embodiments, the system 400 can include a configuration server 490 that an operator can use to configure the group scavenger hunt game. The configuration server 490 can provide a configuration settings panel 491 that includes controls to select a particular group scavenger hunt game (e.g., Frodo's Tree), items associated with the group scavenger hunt game, and controls for setting values associated with the items (e.g., an event, an event type, a number of occurrence for events, award distribution types, award values, award funding sources, etc.). the system 400 can present the player account The flow 300 continues at processing block 312, where the system indicates on an online group-scavenger-hunt progress report that the item was obtained. Depending on the variation of the game, once the event occurs, and the system determines that it will recognize or award the player with an item, the system can automatically indicate, on the trophy case, that the player obtained the item. The system can use the representative item object to indicate the item on the progress report. In other embodiments, however, the system can provide controls for the player who obtained the item to place the item within the progress report. For example, as described above in conjunction with FIG. 4, a player can store a representative item object (e.g., Frodo's painting) in their player account, log on to the website, and place the item onto the web page associated with the item. The web page can indicate that the item was placed, and the system can note in its historical data that the item is no longer needed for the group scavenger hunt game.

The flow 300 continues at processing block 314, where the system provides an award associated with the item to the player account. The system can provide awards in many different ways. For example, the system can provide the awards to the player or divide the award amongst group members. In the case of items that have events that require multiple occurrences, the system can provide an award (1) to a player who finishes first, (2) randomly to one or more of the group members for whom the event occurred, (3) split evenly amongst group members for whom the event occurred, (4) divided proportionately to group members according to performance for that item, or in other ways. Awards can vary in their composition. For example, in some examples, rewards can be recognition. For instance, the system can recognize the player during the wagering game when the event occurred (e.g., via a congratulatory display). In another example, the system can identify the player account that obtained the item on the progress report. For example, in FIGS. 1 and 4 the system presents a player's names, screen names, nicknames, avatars, or other identifiers. The identifying information can be stored in a player account associated with the player. Players can specify their privacy preferences in a player account and select what personal information and/or level of identifying information to display on the progress report. In other embodiments, other than recognition, the system can provide award objects or privileges that have some actual or perceived value, such as credits, free games, merchandise, social network/status points, customer appreciation gifts/points, access to special games, pre-access to new games, etc. Any, or all, of the items, or milestones associated with a group of items, can have awards associated with them. The awards do not have to be related the actual item or representative item object from the scavenger hunt game. For example, a symbol can represent an item, like Frodo Baggins' fireplace tool set, but the award does not have to be a fireplace toolset. However, some awards can be associated with the item or symbol (e.g., a marketing partner may provide a coupon for 50% off fireplace equipment). Awards can be cash or non-cash. In some embodiments, very important items or goals, such as the trophy, can have a cash award, while other, less important items can win non-cash awards. In some embodiments, the system can provide awards that escalate in value as players achieve milestones for the group scavenger hunt game. In other words, as players achieve more items, the system provides awards of greater value or significance for obtaining higher level items that are closer to obtaining the final item and/or trophy. Triggering the event can also add something to a personal trophy case, which will list a virtual scorecard of personal contributions of to the communal trophy case. The personal trophy case can be persistent even beyond the existence of the group trophy case. The system can attribute scores, levels, status, etc. on a personal trophy case for how many items the player obtained so that the player obtains satisfaction on a personal level. The system can utilize game scores, levels, status, etc. to perform better on triggering or obtaining items in some kinds of wagering games, such as bonus games, skill based wagering games, etc. (e.g., a level 5 group member may have a greater chance of obtaining certain items or performing well on certain items than a level 1 group member). In some embodiments, the system can provide offline awards. For example, the system can perform a random drawing to determine who receives awards and save the award to the player's account, even when the player is logged out of the system. The system can provide drawings for awards for trophies, items, milestones, etc. The system can provide players with tickets based on the number of items that a player account obtained during the group scavenger hunt game. By receiving more tickets, a player account would have a greater chance of winning the award. In some examples, if an item requires an event to be obtained multiple times, then the system could award tickets to player accounts based on the number of times that the player account completed the event for the item. Some tickets may be more valuable than others may (e.g., have values greater than one ticket). The system can also provide tickets to players when the player is not online. In some embodiments, the system can provide awards that grow in value the longer that they remain unobtained by a player account during the group scavenger game hunt. In some embodiments, an award can grow in value based on the number of items that a player accomplishes (e.g., an award can take into consideration a player's past performance for the group scavenger hunt game and award a higher-valued award). Some awards can grow like a progressive, or be associated with a progressive. In other examples, some awards can be non-monetary. The system can notify a player when the award is accomplished (e.g., via long-term characters in wagering games, by secondary game bots, etc.), even when the player is logged out of the system (e.g., via email, instant message, text message, cell phone, etc.). The player can pick up the award when the player account is logged on. The system can fund awards in various ways. For example, the system can treat some portion from game bets for a wagering game as a source of funding to fund the scavenger hunt item awards, like progressive type funding. The funding can come from casino wagering games as well as any kind of wagering funding by online games or wagering activity (e.g., online slot games, online sports betting, etc.). Events for the group scavenger hunt game can be events that occur on casino gaming as well as online gaming. Some embodiments can incorporate sponsors that fund the group scavenger hunt game. For example, instead of funding coming from the casino game profit, or from coin-in on casino games, a sponsor (e.g., a third party marketing partner, a casino marketing account, a web marketer, a game manufacturer, etc.) can sponsor and fund awards and prizes for the group scavenger hunt game. The system can split advertising benefits from the group scavenger hunt game between sponsors and casinos. The system can brand any kind of game with the scavenger hunt branding indicating that a wagering game supports the scavenger hunt game. In some embodiments, the system can utilize accomplishments by players to fund awards (e.g., a player may hit a progressive, a large jackpot, a significant prize, a bit win, etc.; the system may use a portion of the winnings to fund awards during the group scavenger hunt game; etc.). The system can redeem awards in different ways. For example, if the wagering game provides the award, the system can provide the award directly to a player's credit meter (e.g. as cash awards). In some embodiments, when playing within a casino, if the group scavenger hunt game is funded outside of the wagering game (e.g., a sponsor funds the group scavenger hunt game), a wagering game machine can provide a printed ticket that can be redeemed at a cashier's box at the casino. The sponsor could then reimburse the casino. When playing online, the system can provide a coupon, such as an e-coupon, a barcode coupon, etc., that a player can use the coupon at a marketing location and redeem the coupon at the marketing location (e.g., the player can print out the coupon take it to a store belonging to the marketing partner, the player can use a coupon code for an online website, etc.). In some embodiments, the system can transfer and/or convert an item the group-scavenger-hunt progress report to an additional (or other) group-scavenger-hunt progress report. For example, the system can transfer the item to the additional group-scavenger-hunt progress report and determine one or more additional items on the additional group-scavenger-hunt progress report that are equivalent in value to the item that was transferred. The system can then indicate that the one or more additional items were obtained for the additional group-scavenger-hunt progress report. In other words, the system can determine item equivalency between different group scavenger hunt games. The system can provide functionality for players to migrate any or all items to different trophy cases, or games (e.g., one or more items from Frodo's Tree, for instance, can have equivalency to some items within a Star Trek Enterprise scavenger hunt game, so that a player can migrate to the new themed trophy case and can apply accomplishments they already achieved from Frodo's Tree.) To determine equivalency, in some embodiments, the system can calculate odds of an event that occurred for an obtained item in one group scavenger hunt game and compare it to odds for an event to occur for an unobtained item in the other group scavenger hunt game. For instance, if a player obtained back-to-back three-of-a-kind hands to obtain the obtained item, the system can determine what the odds were of that event occurring (e.g., 1/5,000). The system can look at an unobtained item (e.g., the next available item to obtain on the other group scavenger hunt game) and determine whether the odds of attaining an unattained event associated with the unobtained item are equivalent to that of the attained event associated with the obtained item, and make a swap. The system can provide controls for the player to determine what unobtained item to obtain, if there is more than one, that matches the same equivalency. In some embodiments, the system can allow a player to swap a higher valued item for multiple lower valued items (e.g., use the item associated with the back-to-back three-of-a-kind hands to swap for two items in the additional group scavenger hunt game, where the two items have lesser odds of being obtained, such as two pocket-ace hand events, but whose combined odds add up to the odds of the back-to-back three of a kind event). The system can also utilize other factors for determining equivalency, other than odds, such as values of awards that were associated with items. In some embodiments, the system can provide equivalency if the player account pays a fee or offers some other value. For example, the player could pay $50, could redeem loyalty points, etc. to swap an item from one group scavenger hunt game to another. In some embodiments, the system can assign transferable values to items (e.g., to representative item objects and/or other virtual assets associated with items) so that players can exchange (e.g., swap, trade, sell, etc.) items with other players (e.g., "I'll trade you Frodo's fireplace tools for Picard's flute.") In some embodiments, the system can provide ways for a player to exchange items within the same group wagering game. For example, FIG. 5 illustrates an example flow 500 that illustrates an example of substituting items within a group scavenger hunt game.

Figure 5:
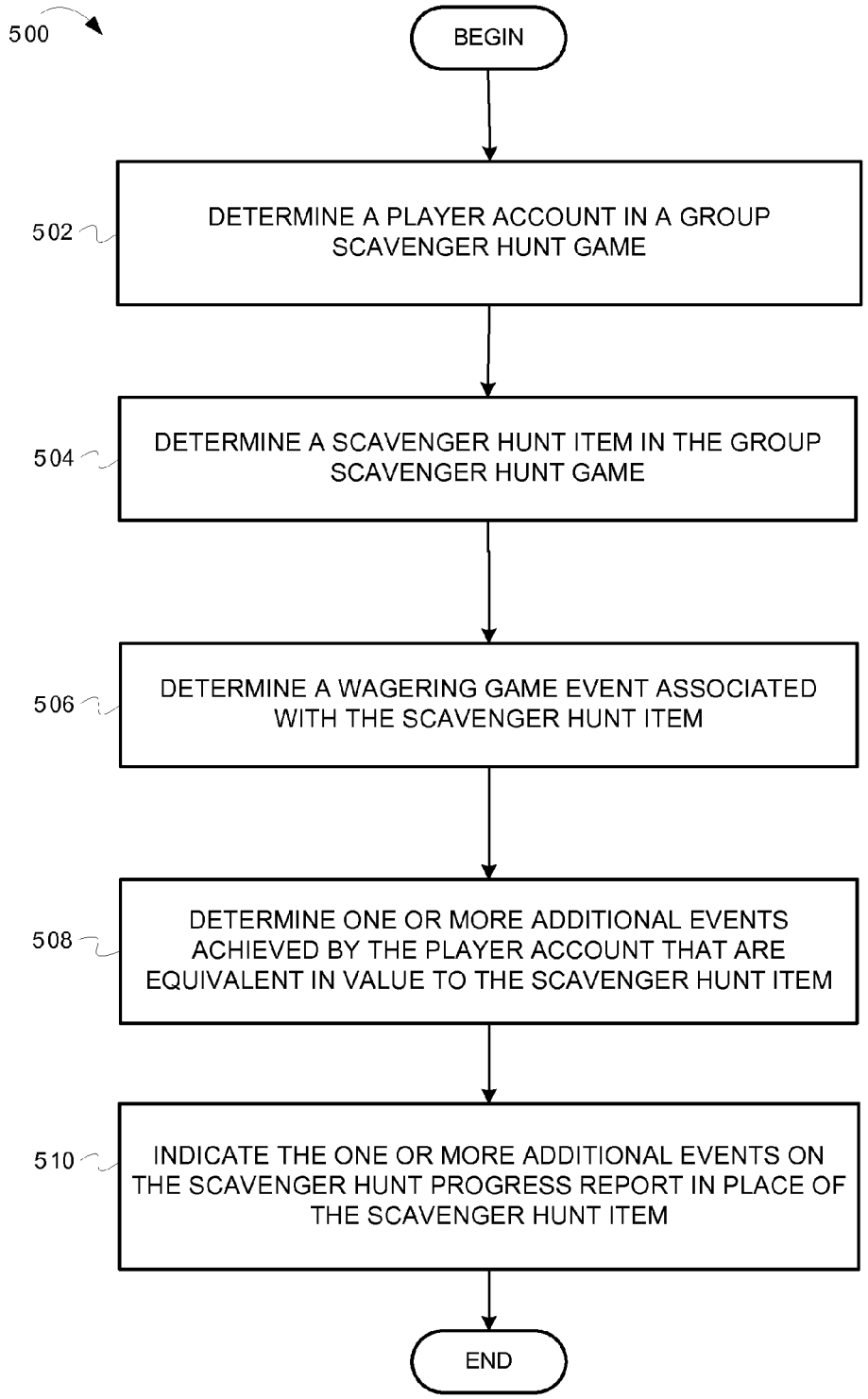
FIG. 5 is a flow diagram 500 illustrating substituting items of equivalent values in a group scavenger hunt game, according to some embodiments.

FIG. 5 is a flow diagram ("flow") 500 illustrating substituting items of equivalent values in a group scavenger hunt game, according to some embodiments. In FIG. 5, the flow 500 begins at processing block 502, where a wagering game system ("system") determines a player account in a group scavenger hunt game.

The flow 500 continues at processing block 504, where the system determines a scavenger hunt item in the group scavenger hunt game.

The flow 500 continues at processing block 506, where the system determines a wagering game event associated with the scavenger hunt item.

The flow 500 continues at processing block 508, where the system determines one or more additional events achieved by the player account that are equivalent in value to the scavenger hunt item. In some embodiments, the system can determine item equivalency by determining values of odds for obtaining an event, values of awards associated with an event, etc. If a player collects one item that is difficult to accomplish, the system can substitute that accomplishment for another item (e.g., five big wins could be equivalent to a back-to-back bonus and one could replace each other in importance).

The flow 500 continues at processing block 510, where the system indicates the one or more additional events on the scavenger hunt progress report in place of the scavenger hunt item.

Figure 6:
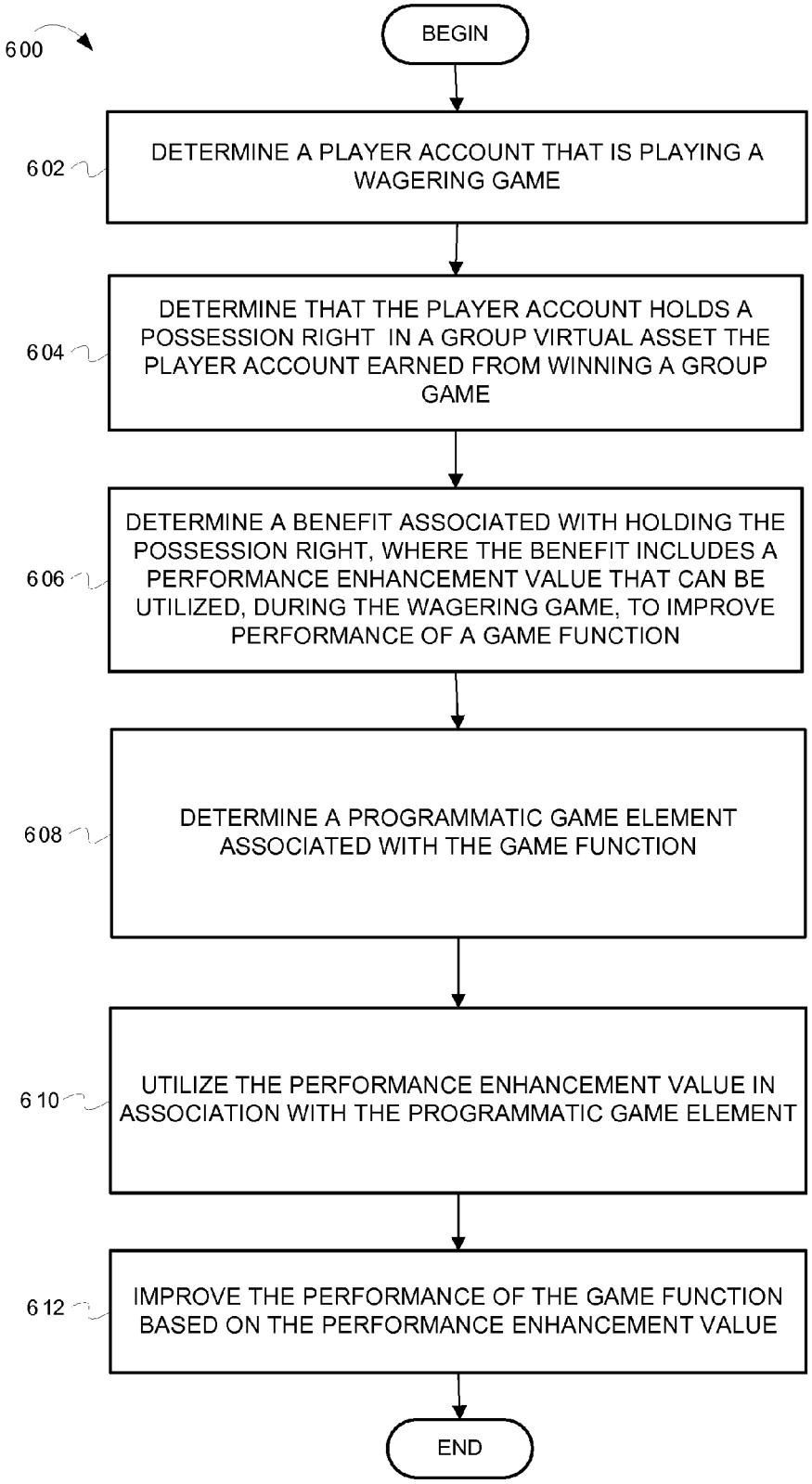
FIG. 6 is a flow diagram 600 illustrating controlling possession rights and benefits associated with trophies for group wagering games, according to some embodiments.
Figure 7:
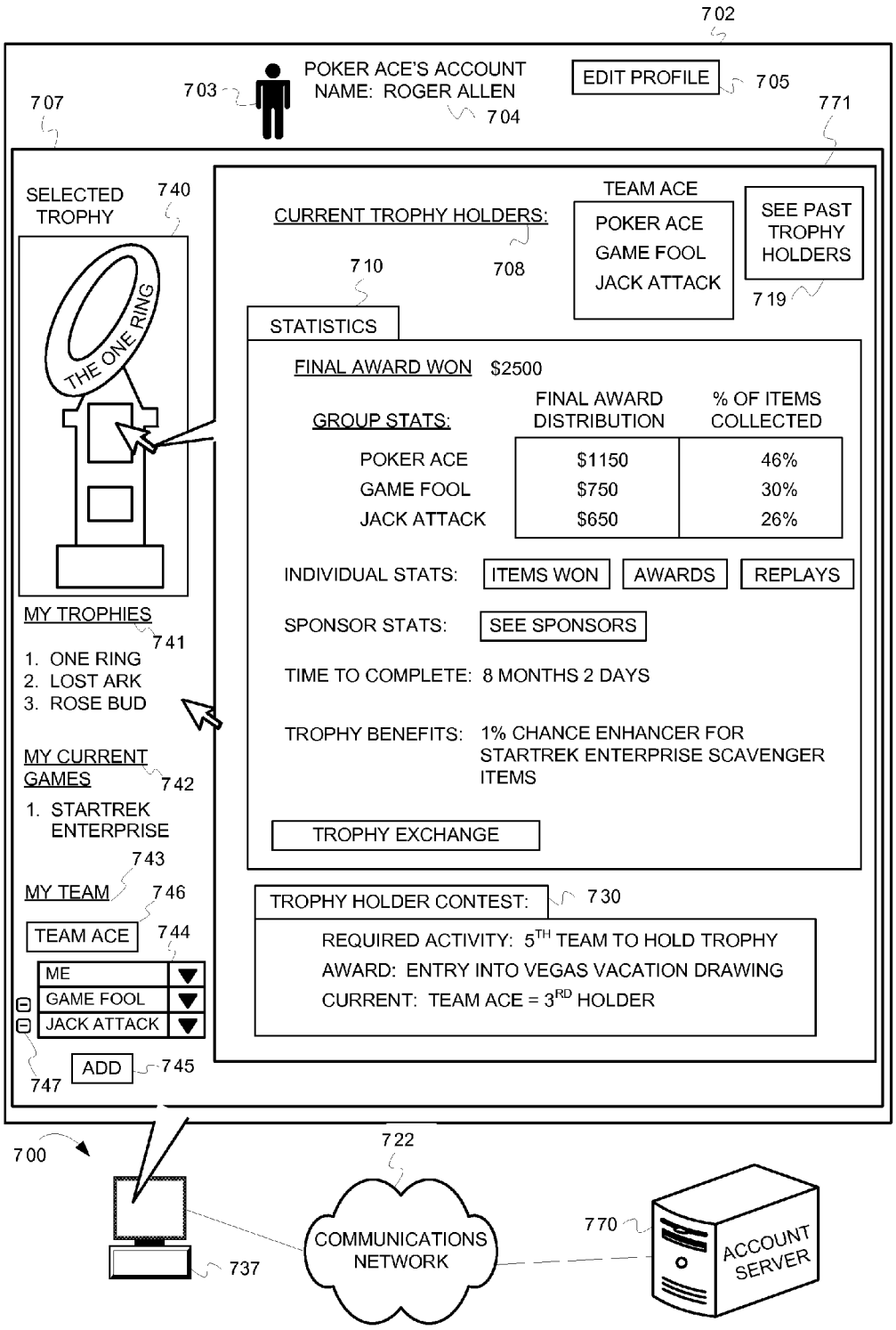
FIG. 7 is an illustration of presenting and controlling trophies, awards, benefits, and group dynamics in player accounts, according to some embodiments.

FIG. 6 is a flow diagram ("flow") 600 illustrating controlling possession rights and benefits associated with trophies for group wagering games, according to some embodiments. FIG. 7 is a conceptual diagram that helps illustrate the flow of FIG. 6, according to some embodiments. This description will present FIG. 6 in concert with FIG. 7. In FIG. 6, the flow 600 begins at processing block 602, where a wagering game system ("system") determines a player account that is playing a wagering game.

The flow 600 continues at processing block 604, where the system determines that the player account holds a possession right in a group virtual asset the player account earned from winning a group game. In some embodiments, the possession rights may also be referred to as an interest, a claim, a share, a stake, an entitlement, a privilege, etc., in the group virtual asset. In some embodiments, the group virtual asset is a trophy in a group scavenger hunt game. In some embodiments, the possession rights are active only as long as dynamic elements permit (e.g., can be active only while a player holds a trophy). In other words, a trophy can have dynamic elements associated with possession of the trophy in the player account. For example, the system can associate a lifetime to a trophy life (e.g., the trophy can have an expiration period for adding award benefits). The system can extend the life of a trophy based on a player's amount and/or performance of play (e.g., a player may hit a five of a kind, hit two three-of-a-kinds in one session, etc., which would extend the lifetime of the trophy). Some dynamic elements can also apply to groups. For example, the system can apply benefits to a group to which the player account belongs (e.g., one player account of a group who holds a possession right in a trophy may have better chances at helping the group to accomplish a group goal). The trophy can be animated and have interactive elements as a virtual asset. For example, FIG. 7 illustrates an example of a virtual trophy ("trophy") 740 that a player can hold in the player account 702. In FIG. 7, the player account 702 can include player information 704, such as a name, an alias, an avatar 703, or other information. The player account can have a profile configuration control 705 in which the player can change player profile settings, including information related to associated social contacts. The player account 702 can include a scavenger hunt game section 707 that displays a trophy list 741 of one or more trophies that a player has earned and which the player may have a current right to possess (a "possession right"). The player account 702 can also include a game list 742 listing all scavenger hunt games that the player account 702 has participated in or in which the player account 702 is currently participating. The system 700 can permit a player to select one of the trophies from the trophy list 741. The system 700 can display an image of a virtual asset (e.g., a representative trophy object), as indicated by the trophy 740. The trophy 740 can include information related to the theme of the scavenger hunt game from which the trophy originated (e.g., the trophy 740 depicts a "One Ring" awarded as an ultimate goal from the "Frodo's Tree" scavenger hunt game). The trophy 740 can be a "traveling" trophy, or rather, a trophy that a player earns and holds for limited time in their own personal trophy case (e.g., in the player account 702, via a personal website, etc.). The trophy 740 can include metadata, settings, properties, etc. that the system 700 displays upon request. For example, a player can position a mouse pointer over the trophy 740 and the system 700 can present a trophy information display 771. The trophy information display 771 can include current holder identification information 708 on the current trophy holders, past holder identification information 719 on past trophy holders, current holder statistics ("statistics") 710 for the current trophy holders, and any secondary contests 730 associated with holding the trophy 740. The statistics 710 can include information such as what any awards were awarded, how the award amounts were divided, individual group member statistics, sponsor information, time to earn the trophy 740, and any trophy benefits associated with holding active possession rights in the trophy 740. The trophy may only be held for a certain amount of time (e.g., only for a year), and, at the expiration of the holding period, the system can remove possession rights to the trophy 740 (e.g., the system 700 can determine a time period associated with holding the active possession right, determine that the time period has expired, and deactivate the possession right). In some embodiments, the system 700 can transfer the possession right to an additional player account for a form of compensation. For example, the system 700 can receive a request to transfer the possession right to an additional player account for a form of compensation (fee payment, trade, swap, lease agreement, auction agreement, sale agreement, etc.) and receive an indication that the form of compensation was provided to the player account. The system 700 can then transfer the possession right to the additional player account.

The flow 600 continues at processing block 606, where the system determines a benefit associated with holding the possession right, wherein the benefit includes a performance enhancement value that can be utilized, during the wagering game, to improve performance of a game function. In some embodiments, the performance of the game function can be associated with one or more of improving a chance that a favorable wagering game event can occur in the wagering game, providing a score multiplier enhancer in a bonus game, providing an extra bet enhancer, improving skill-based performance, providing an extra payout, etc. In some embodiments, the system can generate an award based on who holds the trophy and when (e.g., the 10th person to hold the trophy wins a prize), as indicated in the secondary contests 730 of FIG. 7. The system can also tie holding the trophy into a benefit for secondary games that a player plays (e.g., if a player has held a trophy at some point, the system could provide the player with 10 extra tickets for a drawing).

The flow 600 continues at processing block 608, where the system determines a programmatic game element associated with the game function. The programmatic game element can be one or more of a property, an attribute, a class, a function, a procedure, a method, a subroutine, a subprogram, a rule, a rule set, a data set, a data element, code, etc.

The flow 600 continues at processing block 610, where the system utilizes the performance enhancement value in association with the programmatic game element. For example, the performance enhancement value can be associated as a parameter of, as a property of, in a calculation of, while processing, etc. the programmatic game element The flow 600 continues at processing block 612, where the system improves the performance of the game function based on the performance enhancement value. For example, as shown in FIG. 7, a benefit of holding the trophy 740 is a 1% chance enhancer for finding Star Trek Enterprise scavenger hunt items. Thus, when the player account 702 is playing a wagering game that is associated with the Star Trek Enterprise scavenger hunt game, the system 700 can use the "1%" value (e.g., pass the 1% value as a parameter) into programmatic game elements (e.g., a "chance enhancement" subroutine) of the Star Trek Enterprise scavenger hunt functionality. The programmatic game element could be associated with the event, and improve the chances that the event occurs during a wagering game. In some embodiments, where the event is associated with the rules and/or pay tables of the wagering game, the system 700 may take into consideration the improved chance and compensate for payout percentages accordingly, according to jurisdictional rules and regulations.

Virtual Assets

In some embodiments, the system may utilize a variety of different types of virtual assets ("assets"). The various assets can be associated with a variety of different attributes that govern the way the assets may be collected, redeemed, distributed, earned, etc. For example, the various attributes of the assets may include characteristics such as whether or not a collected asset is persistent or consumable, whether the asset can be bought, sold or traded, whether the asset is associated with any expected value within play of a wagering game, and whether or not the asset has any virtual value, and if so, whether such value is fixed or governed by a market value. Table 1 below lists a variety of example types of virtual assets which can be available to be earned within an embodiment of the gaming systems described herein, as well as an example of attributes associated with such assets:

TABLE 1

| | Attributes | | | |
|---|---|---|---|---|
| Virtual Asset Type | Persistence | Buy/Sell/Trade | EV | Virtual Value |
| Achievements | Yes | No | None | None |
| Things | Consumable | Allowed with points | Allowed | Market |
| Keys | Consumable | Allowed with points | Allowed | Market |
| Points | Yes | Buy with cash | Fixed | Fixed |

In one embodiment, four categories of virtual assets are capable of being transacted: achievements, things, keys, and points, each having various attributes as seen in Table 1. Achievements may be visual items such as ribbons, trophies, or other graphical representations, which are persistent items, awarded for an accomplishment or event. Achievements may be awarded to individual players or groups of players. One or more rule sets govern the awarding of achievements, and thus, such rule sets governs whether or not an achievement is awarded to a group or individual player. If an achievement can only be obtained through a group then a player would need to complete specified criteria to be part of the group and thus eligible for receiving the achievement.

Achievements may be visually depicted as medals, trophies, awards, etc., or as icons or other three-dimensional objects that are easily recognized by players, and designed to provide a visual clue as to the experience of a person within the gaming or social networking communities. Achievements may further be implemented as widgets that have behavior or embedded links. Achievements may be syndicated and may appear in multiple locations or forms associated with a player or group. For example, some achievements may appear on the player's profile as well as in their trophy room. Since achievements may also be awarded to groups or based upon a collective group's activity there may be a category of achievements for groups. Group achievements may appear in all of the player's trophy rooms or profiles that are part of the group, or only within a predetermined subset of the group, for example a leader or captain of the group. There may be a section designated for group achievements in the trophy room where these things would reside.

In an embodiment, and in accordance with the attributes seen in Table 1, achievements can be personal or group mementos and may have restrictions on being purchased, sold or traded. They may have no expected value (EV) and may have no virtual value (i.e. in points). However, achievements may be awarded simultaneously with payouts. For example, a royal flush on a casino video poker game would result in a payout and the award of a Royal Flush Achievement. In another example, a Top Award Achievement may be provided in conjunction with a player achieving a winning outcome on a slot game, which is a top award on the pay table of such wagering game.

In an embodiment, achievements can fall into three primary categories: Game Accomplishments, Events, and Collections. Game Accomplishments can be achievements awarded by a casino or online game for an unusual win or for reaching an in-game goal. Examples might include getting a royal flush in a video poker game; completing an episode of a wagering game; playing an online game for a number of hours or other predetermined time; solving a mystery puzzle online; or hitting the top payment in a slot game. The rules for issuing Game Accomplishments may be stored locally, for example in memory of the individual wagering game terminals themselves. Any particular wagering game may award many different accomplishments. Event achievements may be awarded for participating in events. For example, a Casino Opener achievement may be awarded for playing at a designated new casino within the first ninety days (or other predetermined time) after opening. Note that the primary distinction for an Event Achievement is that it is not awarded by a particular game, but rather is based on the associated event. The Casino Opener achievement described above would be given for playing any game at the new casino within the predetermined time frame. Thus, the rules and mechanisms for issuing Event Achievements may reside centrally in the system, for example in the central gaming facility or other network component centrally accessible.

Collections achievements may further be awarded for collecting combinations of other Achievements. For example, a player may be given a special achievement for participating in five different casino openings. As with the event achievements, the rules and mechanisms for issuing Collection Achievements may reside and be administered centrally, for example by the virtual asset server, rather than in the individual wagering games or terminals. The term Advancing Achievement refers to a type of achievement where a new, higher level achievement replaces a previous, lower-level achievement (e.g., a player does not collect two different achievements but rather collects a single achievement that advances with play).

Another form of virtual asset, as seen in Table 1, is referred to as a thing. "Things" is the generic term for virtual objects that can be purchased, traded or sold within a virtual economy. Things have value in the virtual economy, and in an embodiment, such value is denominated in points. One attribute of things are that they may also have an associated Expected Value (EV), which is held as a mystery until the object is consumed. Note that EV is funded from a funding source. For example, an object such as a thing may be awarded by a game and funded by an award, or a part of an award, in accordance with the pay table of the game. Awarding EV to an object (such as a thing) may constitute a deferred win or award that is hidden from the player, yet preserved in the virtual asset, in this case the thing.

The EV of an object or thing is distinct and separate from the object's virtual points value. For example, a game might award a Blue Mystery Present with an in-game EV of $1.00. The EV is hidden from the player. The player may decide to sell the Blue Mystery present to another player for 75 Points. Thus, the EV is determined by the funding source (in this case the wagering game) while the virtual points value is determined by the virtual market administered by the system as part of the gaming and social network environment. Things may be awarded simultaneously with traditional payouts and credit awards, or independently thereof. For example, a bonus on a slot game may result in a payout and the simultaneous award of a key for an online casual game. Things may be persistent or they may have a single use or limited time of use.

A key is a virtual asset that, as the name implies, unlocks another gaming or networking event. For example, a key may be redeemable for 100 spins of a specified play-for-fun game. The key would count down and expire when the free play was consumed. As a second example, a key that unlocks a premium casual game may be designated as single use. The player may sell the key or they may use it to unlock the associated game. Objects with EV can be consumed and cease to exist when the EV is exhausted. For example, an object may have an EV worth $5.00 in credits that can be converted into a corresponding number of free spins. The object may be sold to another player before it is used. The object is removed or deleted when the EV is consumed. Some objects may be permanent or persistent (like virtual property). For example, a player might purchase a premium avatar from an online store and subsequently sell that avatar to another player.

Virtual assets may further be either useful or ornamental. Useful assets perform an action or enable a feature, for example, keys that unlock online games or game features; keys that reveal a clue or hint needed for an online puzzle or challenge; an asset redeemable for a shopping trip in a virtual store. Ornamental assets can be primarily used for player customization, and may include assets such as premium player avatars, accessories for your avatar(s), graphical decorations such as skins, wallpapers or backgrounds, and premium sounds or ringtones. Virtual assets can be acquired in various ways including being awarded by an in-casino game, awarded by an online game, purchased from an online merchant, or purchased or traded from other players.

In an embodiment, points are a form of virtual currency used within the system. They may be a flexible, fluid currency that players can accumulate or spend. In an embodiment, points may have an EV associated with them, which may require heightened levels of security for transactions involving points. In other embodiments, points may have no EV associated with them, which may permit a lower level of security in transacting points. In some embodiments, it may be desired to have multiple categories of points. For example, there may be some points that can be redeemed for cash and some other points that may only be spent on digital assets. Points, like other virtual assets, may have a digital representation. For example, points may appear either in their own window with a digital representation like gold bars or, in another example, an alphanumeric or graphical representation on a player's avatar. In the avatar example, if a player had enough points their avatar could be modified so to be holding a huge sack of money that grows in proportion to the amount of points they have. In an embodiment, each point has some cash value, for example having a worth of one-tenth of a cent (1000 to the dollar.) Internationally, the value of points may be either linked to the dollar, or points earned in different currencies may be kept separately, and allowed to be only utilized on systems or gaming terminals in the relevant markets where such currency is utilized.

Points may be earned during game play, or alternatively they may be purchased. For example, a player may earn points by selling other assets, such as things; social networking activities, such as submitting reviews that have received a rating of "helpful"; purchasing points with real money; in-casino game play; or in-casino promotions, such as playing games with ads that might have corporate sponsors. Players may sell things (or other virtual assets) they have earned or collected in exchange for points. Points may also be earned through non-gaming activities on other portals of the system. These activities may include playing non-wagering games or entertainment games on the system, for example via the social networking portion of the system; watching advertisements on the social networking system; writing or submitting content for reviews or chat boards on the system; selling creative content on the system; making a purchase of some kind from a vendor having access to the system, where the purchase is accompanied by an award of points from such sponsor as a promotion.

Points may also be purchased directly by players through the social networking's web portals. Moreover, points may be purchased by casinos, other gaming manufacturers, and third parties for use in promotions and as part of games. In other embodiments, points may be earned through casino play, in direct proportion to coin-in, and may be funded by a percentage of coin-in on participating games. Players may also earn points through internet promotions and casino promotions, which can be funded by casino operators, gaming manufacturers, or other third party advertisers. Earning or receiving points may require compliance with eligibility rules, such as meeting a condition, watching an advertisement, playing an advertisement, visiting a casino or playing a certain wagering game or gaming terminal. A casino host or other appropriate casino personnel can directly fund a player's account with points, as part of ongoing promotional efforts. Moreover, player accounts may be limited to a certain number of points per promotion. Additionally, players may be given special points, which they themselves must give away in the form of offers or gifts to other players, which further stimulate interest in the virtual economy. In an embodiment, points are primarily used to buy things or other virtual assets, and form the basis of currency in the virtual economy. In other embodiments, points may be used to buy comps or services within casinos or operator facilities.

In other embodiments, the various virtual assets themselves may be embedded with software code, which may for example contain rule sets. Thus, although a virtual asset may be represented statically, such as a graphic appearing on a video display, it may be stored in memory as a live application or code. By being a live application, the virtual asset may perform various functions, such as connecting with a server or other computers, downloading and uploading data, and refreshing or updating itself with new rules or code. Thus, for example, a virtual asset such as a trophy may interact with other assets or objects. For example, in a poker application, a "Royal Flush" trophy may be awarded to a player achieving a royal flush in a poker game. The Royal Flush trophy may be stored in memory as a live application having its own rules that monitors the player's receipt of other assets. If a player is subsequently awarded a second trophy, for example a "Straight Flush" trophy, the Royal Flush trophy may recognize the receipt of the second trophy, which in turn may cause the Royal Flush trophy (in accordance with its own rules) to award a third trophy (for example, a "High Hand" trophy).

In this way, virtual assets may comprise functioning applications, which contain rules for interacting with other objects. In another example, a virtual asset may have associated therewith code in the form of a decisional tree. For example, the code may have a variety of conditional steps associated with it. Suppose a player possessing a virtual asset (Item A) is allowed to acquire other assets (Items B and C). However, the internal rules and code of Item A further recognize that if the player also possesses a second asset (Item D), then it permits the player to unlock or obtain other assets (Items E and F). In this way, the internal code and rule sets of assets interact with the game code to control play.

As seen in Table 1 herein, each of the virtual assets may have a plurality of attributes associated therewith, which are acted upon by one or more rule sets during play. The attributes may include persistence (whether or not an asset is permanent or has a limited usable life); tradability (whether or not an asset can be purchased, sold, or otherwise traded, and if so, in what value or currency); expected value (whether or not the asset has a cash value associated with it) and virtual value (whether or not the asset has a perceived value associated with it, and if so, whether such perceived value is fixed or controlled by some market affected by players purchasing, selling, or trading such asset). The attributes displayed in Table 1 are examples of attributes that may be utilized in a gaming system. It should be understood that in other embodiments, a large variety of attributes may be used with various types of virtual assets.

The various virtual assets described herein may be utilized in a variety of ways as an integral part of the wagering games of the system, and in conjunction with the social networking aspects of the system(s) described herein. As discussed, virtual assets may be stored and tracked in a player registry associated with a player's account, for example in the form of a player profile or trophy room. Such virtual assets may be displayed to the player in a variety of ways, including for example on a primary display of a gaming terminal in which a player is actively playing, a community display in the casino, or via the display on a mobile device, PDA, mobile telephone, or home computer, such as a laptop. Such virtual assets may be viewed and tracked locally within a casino or operator facility, or may be tracked over a connection through the internet or an internet service provider, such as via a website forming part of the social networking site operated in conjunction with the system.

Although virtual assets are described as being associated with scavenger hunt items, in some embodiments, in other embodiments, the system may award virtual assets in a variety of ways. Gaming events, such as winning outcomes, may be associated with an award of one or more of the types of virtual assets described herein. Moreover, such virtual assets may be awarded randomly to players based upon a variety of gaming and non-gaming events. For example, promotions within casinos may be focused on awarding virtual assets, in addition to, or instead of, cash value prizes. Additionally, the amount or nature of virtual assets awarded to a player may be dependent upon player's accounts, player level or status, accumulation of other assets, or virtually any other criteria of a player's account or profile that may be monitored by the system and evaluated by one or more rule sets. For example, a "platinum" player may receive a different number or quality of virtual assets for a particular event as compared to a "silver" player. Many other configurations are possible.

In some embodiments, some achievements may be awarded based upon accumulation of other achievements or assets, such that the awarding of virtual assets is subject to a hierarchy. For example, collecting achievements such as ribbons may permit a player to be awarded a higher-level achievement, such as a medal, in accordance with one or more rule sets. In an example, collecting ten ribbons provides a player with a medal as an achievement, while further still, collecting ten medals awards the player a trophy, as an achievement or asset. Such hierarchy may be provided to players in a number of ways, including via gaming terminals or over the internet. Moreover, the rules set(s) of the system may further govern which players may win higher-level achievements. For example, in an embodiment, only one player may win a trophy (a higher-level achievement) even though all players are eligible to win lower level achievements. The player winning the trophy may satisfy certain criteria, for example, being the first one to win a certain number of lower level achievements. Other criteria may be employed as well.

In other embodiments, players may be permitted to know the hierarchy and rule set(s) such that they are aware of what collection of achievements is required to receive a higher-level achievement. In alternative embodiments, the rule set(s) and hierarchy may be unknown to players. For example, a secret "Super Trophy" may exist, and although the players may know of the existence of this higher-level achievement, they may not know how it is won. Thus, when a player achieves the requisite underlying achievements to be awarded the Super Trophy, receiving such higher-level achievement will appear as a mystery or surprise to such player. In this way, the element of surprise is maintained in the awarding of higher-level achievements.

In some embodiments, various virtual assets may be accompanied with location information, such that certain casinos and/or operators may "watermark" virtual assets in an effort to advertise where such assets were collected or earned. For example, a trophy won at a Harrah's casino may be watermarked with the Harrah's logo, such that it is known to the player (and other players) where the asset was earned (during game play at a terminal in a Harrah's casino). This provides operators with an opportunity to expand advertisement of their facilities, and gain good will in association with the luck of having such assets awarded. For example, a player having an abundance of virtual assets watermarked as Harrah's brand assets may advertise to other players that Harrah's casinos are lucky and that it is relatively easier to accumulate such virtual assets there. This may induce other players to play more at Harrah's casinos in an effort to collect such virtual assets, thus serving as a benefit to the casino operator in the form of revenue. The player himself may be more induced to play longer at Harrah's since he is left with the sense that when he plays at Harrah's casinos, he is luckier, or does better. In addition to watermarking, other graphical labeling techniques may be employed to designate an asset as having been achieved at a particular casino, location, or region.

Gaming manufacturers may also provide to various casinos and operators software, which is specifically designed to monitor and administer virtual assets. Such a software tool may include management of the various rule sets that govern eligibility for and awarding of the various virtual assets. Operators using the tool may add or subtract virtual assets, change the attributes of assets, change the types of assets available, and change the value of various assets. Moreover, operators could use the tool to advertise the various virtual assets available, the nature in which they may be won, or to advertise special promotions involving such virtual assets in which, for example, the assets take on greater-than-normal value, or the players receive something of value or perceived value in the form of virtual assets.

Operators and gaming manufacturers may also work cooperatively in order to create associations between wagering games and casino locations. For example, certain manufacturers may partner with certain casinos such that the rule sets administered by such a virtual economy system may permit greater or faster accumulation of virtual assets when playing the partnered manufacturer's wagering games within the partnering casino operator's facilities. Certain casinos may be designated as preferred locations where the rule sets are amended to allow increased collection of virtual assets, greater value to such assets, greater redemption value of assets, or other premium features related to virtual assets. In one example, players within a particular casino or playing a particular manufacturer's wagering game or gaming terminal may be permitted to advance more quickly through a hierarchy of achievements. Whereas normally it may be required that ten ribbons be collected to earn a medal achievement, a player playing a Star Trek themed wagering game in a Harrah's casino may be promoted to a medal achievement after collecting only five ribbon achievements.

Moreover, the operator may further define the improvement or "acceleration" of such earning or accumulation of virtual assets based upon player status, player account level, player card level, or other criteria. For example, players holding Harrah's Total Rewards cards may be further differentiated by card level. A gold-card holder may receive a first acceleration level (five ribbons required to earn a medal) while a platinum-card holder may receive an improved second acceleration level (only three ribbons required to earn a medal). Other configurations to effectuate different accelerators are possible as well. In an embodiment, such acceleration information is stored in memory of the central gaming location, accessible to the administration of the virtual assets, for example, by the virtual asset server. In yet other embodiments, a variety of other information tracked or accessible to an operator may be used to configure the rule sets that govern collection of virtual assets. For example, information relating to player level, length of stay at the casino, average bet, player demographics, etc. may all be used to customize or tailor a rule set which governs how that player is eligible to earn, receive, collect, redeem, trade, buy, sell, or otherwise utilize available virtual assets.

Additionally, in other embodiments, any of the described virtual assets may have time limits or expirations associated with them, including all of the assets described in Table 1 herein. For example, things, keys, points, and achievements may all be associated with an expiration date, for example, one hour, one day, one week, one month, or one year. This provides a shelf life for each such virtual asset, which can be configured to optimize the use and/or redemption of such virtual assets. In yet other embodiments, receipt or collection of certain assets, such as achievements, may unlock other non-gaming experiences or events. For example, a player earning certain achievements or keys may be permitted to engage in a variety of non-gaming events over the social networking website. This may include, for example, playing entertainment games accessible only to players having such assets, achievements or keys. Other examples may include ability to improve player profiles, have premium graphics, sounds, or otherwise enhance environmental factors on the social networking site.

In yet other embodiments, a player may be able to create his or her own virtual assets, such as customized player achievements. Such a player may offer his specially configured achievements to friends, family, or members of that player's friend list, for example. Software accessible over gaming terminals or via the social networking site may permit players with tools to build such player customized assets, and offer such assets to others in the gaming or networking community. This may be further improved with the ability to permit players to issue challenges to other players, such as his or her friends or buddies, or to players in general as part of the community. A player creating such a challenge may be rewarded with additional or improved virtual assets by other players' inability to complete the challenge, whereas players accepting such a challenge may be awarded with additional or improved virtual assets by successfully completing the challenge.

Moreover, in other embodiments, the social networking aspect of the system may permit players to provide input for future use. For example, players may provide input on goals or desired achievements, which the operator may then use to create new achievements or other virtual assets when the operator perceives that a substantial or significant population of players would benefit from such creation. This may in turn lead to new sub-communities within the social networking site of players similarly situated with goals and desired achievements, which may in turn foster additional input and more growth of both gaming and social networking events. The system may use tags or markers with which to monitor player's goals or desires. For example, the software of the system may monitor player profiles for certain tags which are associated with players' desired goals, plans, or desired changes to the system. By collecting such tagged information, the system can modify future virtual assets as well as the rule sets governing how they are earned, redeemed, and otherwise administered.

The social networking website and its components administered by the system may provide an arena in which virtual assets are managed, even by persons who are not wagering game players. For example, a person's part of the social networking environment may not engage in wagering games within casinos and operator facilities. However, they may have a desire for collecting and redeeming virtual assets to improve their social networking experience. In one example, a non-gaming participant in the social networking site may want to collect achievements or other assets to improve the graphics of his player profile, or to play entertainment games available only to those having certain assets. The social networking site may further permit brokering of virtual assets in an effort to assist players needing certain assets and desirous of trading for or purchasing such assets.

In another alternative embodiment, one or more "virtual trophies" may be used to stimulate game play and competition. For example, a virtual trophy may be provided to a player for receiving or accomplishing certain tasks or achievements during game play. For instance, in some embodiments, virtual trophies are described as being awarded in conjunction with winning a group scavenger hunt game. In other embodiments, however, separate virtual trophies can be awarded for achievements such as largest jackpot, most games played, most assets collected, most points earned, collection of certain symbols, advancement to highest episodes or stages, etc. The virtual trophies may be awarded for various achievements both inside of a casino or gaming environment, or remote therefrom, for example via game play on the internet, or a mobile device. In one embodiment, player's participation and collaboration on internet websites is a metric for which one or more trophies are awarded. The virtual trophies may be "travelling" trophies in the sense that when a person's achievement is surpassed by another player, the virtual trophy is passed from the first player to the second player. In one embodiment, the players' game play and accumulation of achievements is monitored via their player accounts, stored on a gaming system. The second player "winning" the trophy by overtaking the achievement of the first player possessing the trophy is notified of his receiving the virtual trophy while the first player "losing" the trophy is notified of his loss of the trophy. The first player may also be encouraged to return or continue game play in an effort to re-take the trophy. The encouragement may include audio and video displays, as well as incentives for game play. The travelling trophy may be optionally associated with a leader board that indicates how close players are to overtaking the leader and possessing the trophy.

Moreover, the gaming system operator (casino) as well as gaming device manufacturers may maintain internet websites to monitor, track, post results, and encourage game play through advertisement of the virtual trophies. The available trophies may be advertised along with the current possessor of the trophy and the current achievement necessary to overtake the possessor and gain the trophy. Moreover, players may be permitted to create their own personal websites (either linked to the casino and manufacturer sites, or remote therefrom) in which they can showcase their personal gaming achievements, including, for example, possession of certain trophies, achievements associated therewith, time of possession of trophies, etc. In one embodiment, players may maintain "virtual trophy cases" in which to show off and promote their current and past trophy winnings. Such trophy cases may be visible via websites, as well as via gaming devices, mobile devices, or other displays within a casino environment. In one embodiment, websites permitting wagering game play thereon may generate embeddable web objects that represent various players and their accomplishments or trophies. Such embeddable web objects may "follow" player icons, screen names, identifiers, or other representations to non-gaming websites and be inserted therein. This fosters and promotes play of the wagering game, by advertising player's gaming activities on non-gaming websites, such as social networking websites, for example.

The awarding, overtaking, loss of, transfer, and creation of virtual trophies may be advertised to players in any number of manners. Such events may be advertised, displayed or announced (visually and/or with audio) on individual gaming devices within a casino, including freestanding gaming devices and handheld devices. The events related to the virtual trophies may further be announced on personal mobile devices, casino signage located throughout a casino property, community displays, etc. For example, when a player possessing a trophy commences play at a gaming device (and the gaming device, via the player account on the system identifies the player), that player's possession of a certain trophy may be advertised by one or more displays or other signage on the gaming device, so as to promote to others in the casino that the player is a trophy holder. Moreover, the announcements may be made on internet websites as described above. By updated, displaying, and advertising these events, interest is generated in the competition for and receipt of the trophies. Players may be motivated by the "bragging rights" attendant to owning the trophy and being the "best" or having the highest associated achievement.

Moreover, player accounts on the system may permit players to create and maintain friends, contacts, associates, or "buddy lists" of other players. This may include their friends, family, relatives, etc. Through the system, players earning sufficient achievements to receive one or more virtual trophies may be permitted to notify persons on their contact or buddy lists of their accomplishment, furthering their ability to exercise "bragging rights" associated with the accomplishment. Messages may be broadcast to such persons (or any subsets thereof) via the system, which relate to and announce events associated with the creation, winning, loss, etc. of the virtual trophies. Gaming operators and/or manufacturers operating such systems may be provided with great flexibility to manage the virtual trophies via the gaming system and remote websites. For example, many forms of eligibility criteria may be imposed and controlled via one or more rule sets created and managed by gaming operators or manufacturers via the system or internet sites.

In yet another embodiment, a casino or operator may use the virtual assets and the economy supporting such assets to drive play to various casino sites, or even to specific areas or gaming terminals within a casino. For example, the rule set(s) created for administering the virtual assets available on the system may include a subset of rules for enhancing a player's collection of assets if particular geographical locations and/or timing are utilized in collection of the assets. In one example, a player may be informed by the system that if he or she collects a virtual asset or group of assets from a particular set of casinos, he or she will receive an enhancement thereto, or perhaps an acceleration thereto as described herein. Alternatively, the rule set may provide enhancements to players playing certain gaming terminals or wagering games within a casino. Time limits may be placed on such collection to incentivize players to play at certain casinos or locations within certain time periods. Thus, for example, a casino operator may drive players to increase revenue during certain traditionally lower-revenue time periods by incentivizing players via increased or accelerated virtual assets. Other adjustments to rule sets may be made to drive gaming traffic at appropriate locations and time frames.

It should be understood that any of the embodiments described herein may be implemented in an online casino gaming system, as well as traditional "brick-and-mortar" casino and wagering facilities. It should also be understood that in some embodiments, player information, including virtual asset information, is stored in a player account accessible by verification or recognition of a player identifier (such as a player card). In such embodiments, the information may be stored centrally, for example on a server, and recalled upon receipt of the player identifier. In other embodiments, player information (including virtual asset information) may actually be stored directly on the player card, or other tangible medium. For example, a smart card or key fob may be used as both a player identifier, as well as have memory in which player information is stored and downloaded to a gaming terminal or the system.

In yet other embodiments, casino operators may run special promotions related to the collections of virtual assets. For example, a monthly drawing may be provided (for example a drawing for $1,000.00) in which all players who earned a predetermined number of virtual assets (e.g. 50 Star Trek Medals) would be eligible to participate. Since the gaming system tracks the players (by player account information) who received the earned virtual assets, the system is able to identify the eligible players from the information stored therein. Thus, the system may dispatch systematic advertisement and promotional materials to such players regarding the special event. For example, all eligible players may receive an email, phone call, or postal mailing announcing the special drawing, and their eligibility for it. Additional prizes may be given to players for responding to such promotions, or participating in other ways.

In yet another embodiment, the gaming systems described herein may be used to administrate other promotions. For example, a "bottle cap" type promotion may be instituted and administrated via such a gaming system. During play of wagering games, players may earn virtual assets in the form of a unique code, which is randomly generated and attached to a virtual asset. By earning the asset, the player gets the value of the asset being stored or logged in his or her player account, as well as the secondary value of the unique code attached thereto which allows the player to participate in a secondary game or drawing, provided certain eligibility criteria are satisfied. For example, all of the codes distributed in such manner may be maintained and monitored by the gaming system. Players receiving such codes may redeem them, for example by entering them at an appropriate website address over the internet, or even at a gaming terminal in a casino. The code could then be evaluated to see if the player redeeming it receives an associated prize or status associated with the code. Eligibility requirements for the codes may include having a certain set of virtual assets in one player's account. Thus, the randomly distributed codes provide a secondary level of award and thus, add anticipation and excitement to the collection of virtual assets.

Embodiments offer substantial benefits to players and operators alike. By providing a virtual economy, various players are incentivized to engage in various game play to collect, receive, accumulate, redeem, accelerate or enhance virtual assets available on the system. Virtual assets may include things, points, keys, achievements, or other assets, which are provided via a number of manners, both dependent upon and independent of game play. Various attributes of the available assets may further customize a player's experience, including the ability to buy, sell, trade, barter with or redeem the assets. Such virtual assets may be coordinated with activities outside of the casino, including non-gaming activities, to correspond with and enhance a social networking environment, which interfaces with operators' systems. By promoting such virtual assets, a virtual economy may be created which fosters game play, and is additionally fostered by game players even when not in a casino. Other benefits are provided as well.

Additional Example Operating Environments

This section describes example operating environments, systems and networks, and presents structural aspects of some embodiments.

Computer System

Figure 8:
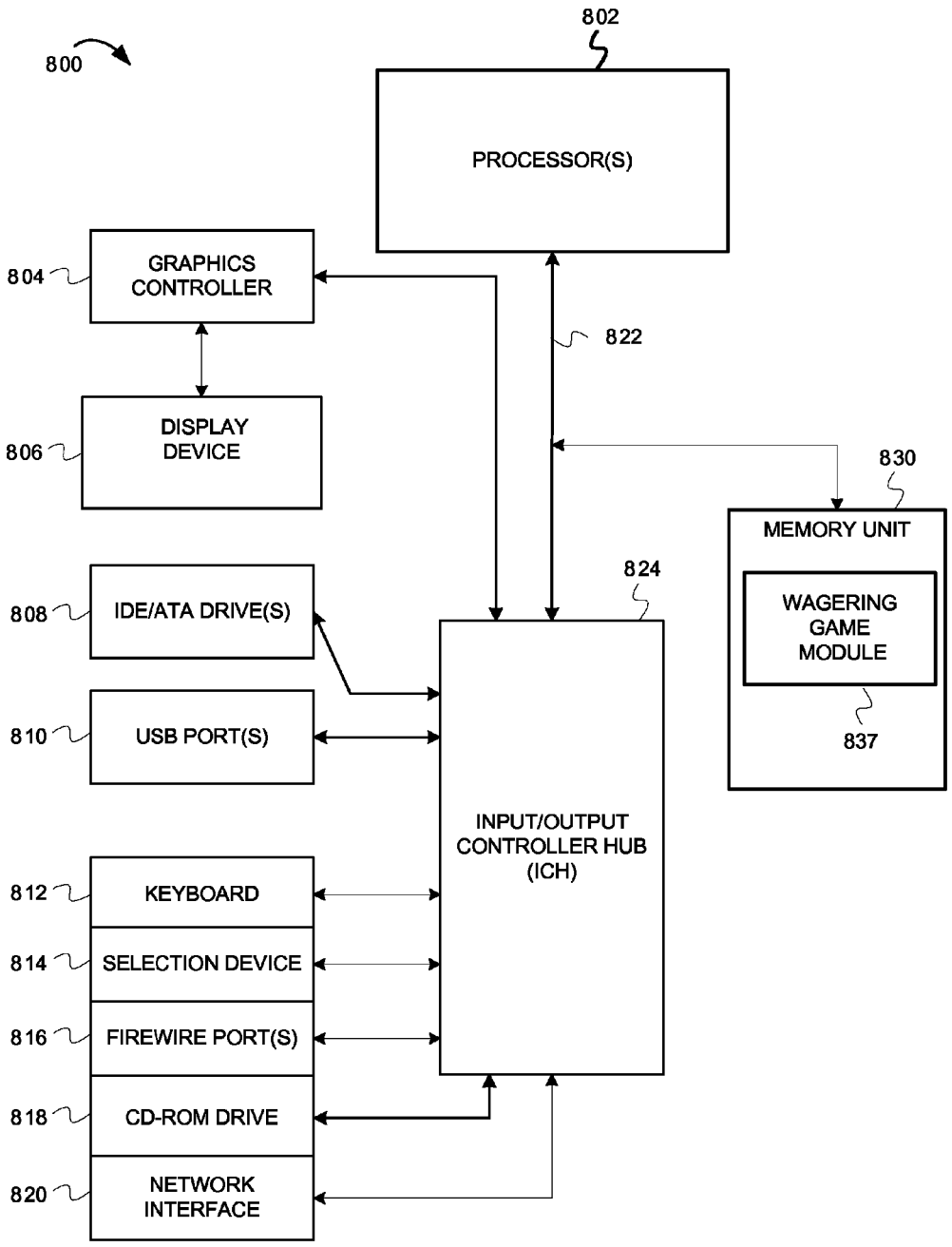
FIG. 8 is an illustration of a computer system 800, according to some embodiments.

FIG. 8 is a conceptual diagram that illustrates an example of a computer system 800, according to some embodiments. FIG. 8 illustrates an exemplary computer system 800 used in conjunction with some embodiments. As shown in FIG. 8, the computer system 800 may include a processor unit 802, a memory unit 830, a processor bus 822, and an Input/Output controller hub (ICH) 824. The processor unit 802, the memory unit 830, and the ICH 824 may be coupled to the processor bus 822. The processor unit 802 may comprise any suitable processor architecture. The computer system 800 may comprise one, two, three, or more processors, any of which may execute a set of instructions in accordance with some embodiments.

The memory unit 830 may also include an I/O scheduling policy unit and I/O schedulers. The memory unit 830 can store data and/or instructions, and may comprise any suitable memory, such as a dynamic random access memory (DRAM), for example. The computer system 800 may also include one or more integrated drive electronics (IDE) drive(s) 808 and/or other suitable storage devices. A graphics controller 804 controls the display of information on a display device 806, according to some embodiments.

The input/output controller hub (ICH) 824 provides an interface to I/O devices or peripheral components for the computer system 800. The ICH 824 may comprise any suitable interface controller to provide for any suitable communication link to the processor unit 802, the memory unit 830 and/or to any suitable device or component in communication with the ICH 824. The ICH 824 can provide suitable arbitration and buffering for each interface.

For one embodiment, the ICH 824 provides an interface to the one or more IDE drives 808, such as a hard disk drive (HDD) or compact disc read only memory (CD ROM) drive, or to suitable universal serial bus (USB) devices through one or more USB ports 810. For one embodiment, the ICH 824 also provides an interface to a keyboard 812, selection device 814 (e.g., a mouse, trackball, touchpad, etc.), CD-ROM drive 818, and one or more suitable devices through one or more firewire ports 816. For one embodiment, the ICH 824 also provides a network interface 820 though which the computer system 800 can communicate with other computers and/or devices.

The computer system 800 may also include a machine-readable medium that stores a set of instructions (e.g., software) embodying any one, or all, of the methodologies for present group wagering games and awards. Furthermore, software can reside, completely or at least partially, within the memory unit 830 and/or within the processor unit 802. The computer system 800 can also include a wagering game module 837. The wagering game module 837 can process communications, commands, or other information, to present group wagering games and awards, according to embodiments. Any component of the computer system 800 can be implemented as hardware, firmware, and/or machine-readable media including instructions for performing the operations described herein.

Wagering Game Machine Architecture

Figure 9:
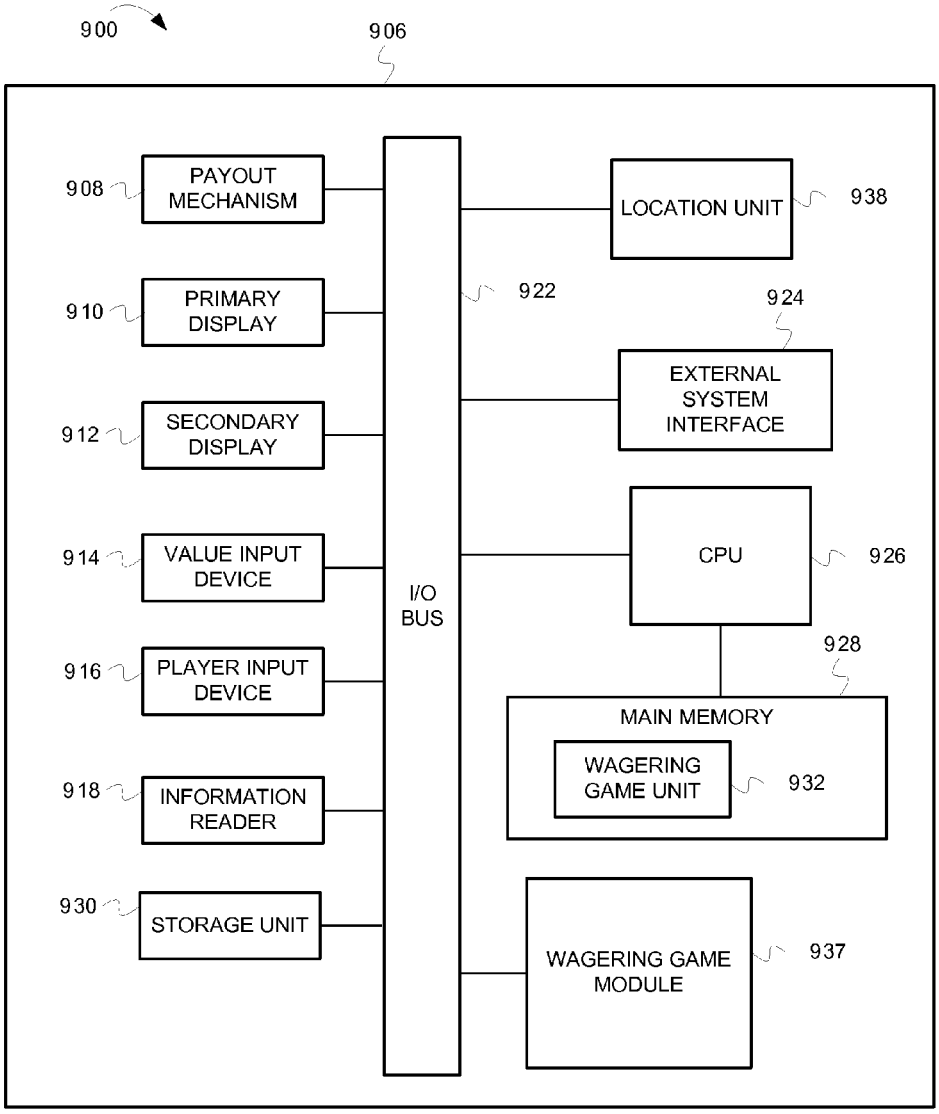
FIG. 9 is an illustration of a wagering game machine architecture 900, according to some embodiments.

FIG. 9 is a conceptual diagram that illustrates an example of a wagering game machine architecture 900, according to some embodiments. In FIG. 9, the wagering game machine architecture 900 includes a wagering game machine 906, which includes a central processing unit (CPU) 926 connected to main memory 928. The CPU 926 can include any suitable processor, such as an Intel® Pentium processor, Intel® Core 2 Duo processor, AMD Opteron™ processor, or UltraSPARC processor. The main memory 928 includes a wagering game unit 932. In some embodiments, the wagering game unit 932 can present wagering games, such as video poker, video black jack, video slots, video lottery, reel slots, etc., in whole or part.

The CPU 926 is also connected to an input/output ("I/O") bus 922, which can include any suitable bus technologies, such as an AGTL+ frontside bus and a PCI backside bus. The I/O bus 922 is connected to a payout mechanism 908, primary display 910, secondary display 912, value input device 914, player input device 916, information reader 918, and storage unit 930. The player input device 916 can include the value input device 914 to the extent the player input device 916 is used to place wagers. The I/O bus 922 is also connected to an external system interface 924, which is connected to external systems (e.g., wagering game networks). The external system interface 924 can include logic for exchanging information over wired and wireless networks (e.g., 802.11g transceiver, Bluetooth transceiver, Ethernet transceiver, etc.)

The I/O bus 922 is also connected to a location unit 938. The location unit 938 can create player information that indicates the wagering game machine's location/movements in a casino. In some embodiments, the location unit 938 includes a global positioning system (GPS) receiver that can determine the wagering game machine's location using GPS satellites. In other embodiments, the location unit 938 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 9, in some embodiments, the location unit 938 is not connected to the I/O bus 922.

In some embodiments, the wagering game machine 906 can include additional peripheral devices and/or more than one of each component shown in FIG. 9. For example, in some embodiments, the wagering game machine 906 can include multiple external system interfaces 924 and/or multiple CPUs 926. In some embodiments, any of the components can be integrated or subdivided.

In some embodiments, the wagering game machine 906 includes a wagering game module 937. The wagering game module 937 can process communications, commands, or other information, where the processing can present group wagering games and awards, according to embodiments.

Furthermore, any component of the wagering game machine 906 can include hardware, firmware, and/or machine-readable media including instructions for performing the operations described herein.

Mobile Wagering Game Machine

Figure 10:
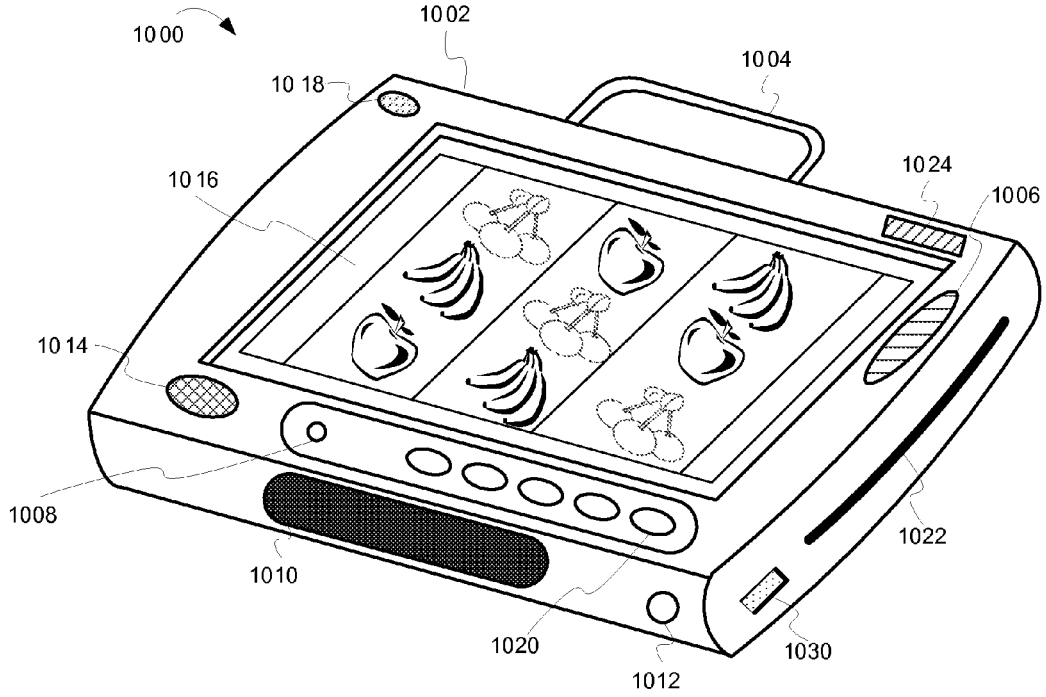
FIG. 10 is an illustration of a mobile wagering game machine 1000, according to some embodiments.

FIG. 10 is a conceptual diagram that illustrates an example of a mobile wagering game machine 1000, according to some embodiments. In FIG. 10, the mobile wagering game machine 1000 includes a housing 1002 for containing internal hardware and/or software such as that described above vis-à-vis FIG. 9. In some embodiments, the housing has a form factor similar to a tablet PC, while other embodiments have different form factors. For example, the mobile wagering game machine 1000 can exhibit smaller form factors, similar to those associated with personal digital assistants. In some embodiments, a handle 1004 is attached to the housing 1002. Additionally, the housing can store a foldout stand 1010, which can hold the mobile wagering game machine 1000 upright or semi-upright on a table or other flat surface.

The mobile wagering game machine 1000 includes several input/output devices. In particular, the mobile wagering game machine 1000 includes buttons 1020, audio jack 1008, speaker 1014, display 1016, biometric device 1006, wireless transmission devices (e.g., wireless communication units 1012 and 1024), microphone 1018, and card reader 1022. Additionally, the mobile wagering game machine can include tilt, orientation, ambient light, or other environmental sensors.

In some embodiments, the mobile wagering game machine 1000 uses the biometric device 1006 for authenticating players, whereas it uses the display 1016 and the speaker 1014 for presenting wagering game results and other information (e.g., credits, progressive jackpots, etc.). The mobile wagering game machine 1000 can also present audio through the audio jack 1008 or through a wireless link such as Bluetooth.

In some embodiments, the wireless communication unit 1012 can include infrared wireless communications technology for receiving wagering game content while docked in a wager gaming station. The wireless communication unit 1024 can include an 802.11G transceiver for connecting to and exchanging information with wireless access points. The wireless communication unit 1024 can include a Bluetooth transceiver for exchanging information with other Bluetooth enabled devices.

In some embodiments, the mobile wagering game machine 1000 is constructed from damage resistant materials, such as polymer plastics. Portions of the mobile wagering game machine 1000 can be constructed from non-porous plastics, which exhibit antimicrobial qualities. Also, the mobile wagering game machine 1000 can be liquid resistant for easy cleaning and sanitization.

In some embodiments, the mobile wagering game machine 1000 can also include an input/output ("I/O") port 1030 for connecting directly to another device, such as to a peripheral device, a secondary mobile machine, etc. Furthermore, any component of the mobile wagering game machine 1000 can include hardware, firmware, and/or machine-readable media including instructions for performing the operations described herein.

The described embodiments may be provided as a computer program product, or software, that may include a machine-readable medium having stored thereon instructions, which may be used to program a computer system (or other electronic device(s)) to perform a process according to embodiments(s), whether presently described or not, because every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. One or more non-transitory, machine-readable storage media having instructions stored thereon, which when executed by a set of one or more processors of a gaming system cause the gaming system to perform operations comprising:

accessing, via a network communication interface of the gaming system, a first player account during a wagering game session initiated via the gaming system, wherein the first player account holds a possession right to a first virtual object earned from winning a first group game, and wherein the gaming system includes a value input device configured to receive monetary value for placement of one or more wagers on an electronic wagering game presented during the wagering game session;

detecting, in response to user input received via a control device of the gaming system, use of the first virtual object during play of the electronic wagering game during the wagering game session, wherein the play of the electronic wagering game involves the one or more wagers; and improving a performance of a game function for the electronic wagering game based on the use of the first virtual object, wherein the possession right to the first virtual object persists with the first player account after improving the performance of the game function for the electronic wagering game, and wherein the improving the performance of the game function causes a game reward payable via a value output mechanism associated with the gaming system.

2. The one or more non-transitory, machine-readable storage media of claim 1, wherein said operation of improving the performance of the game function for the electronic wagering game based on the use of the first virtual object comprises one or more of improving a chance that a favorable wagering game event occurs in the electronic wagering game, providing a score multiplier enhancer in a bonus game associated with the electronic wagering game, providing a bet enhancer during the electronic wagering game, or increasing a skill-based performance of the electronic wagering game.

3. The one or more non-transitory, machine-readable storage media of claim 1, said operations further comprising:

detecting an occurrence of a wagering game outcome that occurs in response to use of the first virtual object; and extending an expiration period for the possession right to the first virtual object based on the occurrence of the wagering game outcome.

4. The one or more non-transitory, machine-readable storage media of claim 1, said operations further comprising:

receiving a request to transfer the possession right to the first virtual object to a second player account for a form of compensation;

receiving an indication that the form of compensation was provided to the second player account; and transferring the possession right to the first virtual object to the second player account after receiving the indication.

5. The one or more non-transitory, machine-readable storage media of claim 1, said operations further comprising:

calculating a first value for the first virtual object;

comparing the first value to a second value for an unattained second virtual object in a second group game;

determining that the first value and the second value are equivalent; and transferring the first virtual object to the second group game.

6. The one or more non-transitory, machine-readable storage media of claim 1, said operations further comprising:

detecting a request, in response to player input associated with the first player account, to exchange the first virtual object as a substitute for a second virtual object in a second group game, wherein the first virtual object was obtained by occurrence of a first wagering game event, and wherein the first virtual object and the second virtual object represent attainment of objectives in the first group game and the second group game;

calculating that a first odds of occurrence of a second wagering game event for the second virtual object is equivalent to a second odds of occurrence of the first wagering game event; and exchanging the first virtual object of the first group game as the substitute for the second virtual object of the second group game, in response to calculating that the first odds of occurrence is equivalent to the second odds of occurrence.

7. A gaming system comprising:

one or more electronic processing units;

a network communication interface;

a user-input control device;

a value input device configured to receive monetary value for placement of one or more wagers in an electronic wagering game;

a value output device; and one or more memory storage devices configured to store instructions which, when executed by at least one of the one or more electronic processing units, cause the gaming system to perform operations to initiate the electronic wagering game, access, via the network communication interface, a first player account, wherein the first player account holds a possession right to a first virtual object earned from winning a first group game played before initiation of the electronic wagering game, detect, in response to use of the user-input control device, use of the first virtual object during play of the electronic wagering game, wherein the play of the electronic wagering game involves the one or more wagers, and improve a performance of a game function for the electronic wagering game based on the use of the first virtual object, wherein the possession right to the first virtual object persists with the first player account after improvement to the performance of the game function, and wherein the improvement to the performance of the game function causes a game reward payable via the value output device.

8. The gaming system of claim 7, wherein the one or more memory storage devices are configured to store instructions which, when executed by at least one of the one or more electronic processing units, cause the gaming system to perform operations to one or more of improve a chance that a favorable wagering game event occurs in the electronic wagering game, provide a score multiplier enhancer in a bonus game associated with the electronic wagering game, provide a bet enhancer during the electronic wagering game, or increase a skill-based performance of the electronic wagering game.

9. The gaming system of claim 7, wherein the one or more memory storage devices are configured to store instructions which, when executed by at least one of the one or more electronic processing units, cause the gaming system to perform operations to:

detect an occurrence of a wagering game outcome that occurs in response to use of the first virtual object; and extend an expiration period for the possession right to the first virtual object based on the occurrence of the wagering game outcome.

10. The gaming system of claim 7, wherein the one or more memory storage devices are configured to store instructions which, when executed by at least one of the one or more electronic processing units, cause the gaming system to perform operations to:

receive a request to transfer the possession right to the first virtual object to a second player account for a form of compensation;

receive an indication that the form of compensation was provided to the second player account; and transfer the possession right to the first virtual object to the second player account after receiving the indication.

11. The gaming system of claim 7, wherein the one or more memory storage devices are configured to store instructions which, when executed by at least one of the one or more electronic processing units, cause the gaming system to perform operations to:

calculate a first value for the first virtual object;

compare the first value to a second value for an unattained second virtual object in a second group game;

determine that the first value and the second value are equivalent; and transfer the first virtual object to the second group game.

12. The gaming system of claim 7, wherein the one or more memory storage devices are configured to store instructions which, when executed by at least one of the one or more electronic processing units, cause the gaming system to perform operations to:

detect a request, in response to player input associated with the first player account, to exchange the first virtual object as a substitute for a second virtual object of a second group game, wherein the first virtual object was obtained by occurrence of a first wagering game event, and wherein the first virtual object and the second virtual object represent attainment of objectives in the first group game and the second group game;

calculate that a first odds of occurrence of a second wagering game event for the second virtual object is equivalent to a second odds of occurrence of the first wagering game event; and exchange the first virtual object of the first group game as the substitute for the second virtual object of the second group game, in response to calculating that the first odds of occurrence is equivalent to the second odds of occurrence.

13. A method of operating a gaming system, said method comprising:

accessing, via a network communication interface of the gaming system, a first player account, wherein the first player account holds a possession right to a first virtual object earned from winning a first group game played before initiation of an electronic wagering game, wherein the gaming system includes a value input device configured to receive monetary value for placement of one or more wagers for the electronic wagering game;

detecting, in response to user input from a user-input control device of the gaming system, use of the first virtual object during play of the electronic wagering game, wherein the play of the electronic wagering game involves the one or more wagers; and improving, via one or more electronic processing units of the gaming system, a performance of a game function for the electronic wagering game based on the use of the first virtual object, wherein the possession right to the first virtual object persists with the first player account after improving the performance of the game function for the electronic wagering game, and wherein the improving the performance of the game function causes a game reward payable via a value output mechanism associated with the gaming system.

14. The method of claim 13, wherein said improving the performance of the game function for the electronic wagering game based on the use of the first virtual object comprises one or more of improving a chance that a favorable wagering game event occurs in the electronic wagering game, providing a score multiplier enhancer in a bonus game associated with the electronic wagering game, providing a bet enhancer during the electronic wagering game, or increasing a skill-based performance of the electronic wagering game.

15. The method of claim 13 further comprising:

detecting an occurrence of a wagering game outcome that occurs in response to use of the first virtual object; and extending an expiration period for the possession right to the first virtual object based on the occurrence of the wagering game outcome.

16. The method of claim 13 further comprising:

receiving a request to transfer the possession right to the first virtual object to a second player account for a form of compensation;

receiving an indication that the form of compensation was provided to the second player account; and transferring the possession right to the first virtual object to the second player account after receiving the indication.

17. The method of claim 13 further comprising:

calculating a first value for the first virtual object;

comparing the first value to a second value for an unattained second virtual object in a second group game;

determining that the first value and the second value are equivalent; and transferring the first virtual object to the second group game.

18. The method of claim 13 further comprising:

detecting a request, in response to player input associated with the first player account, to exchange the first virtual object as a substitute for a second virtual object of a second group game, wherein the first virtual object was obtained by occurrence of a first wagering game event, and wherein the first virtual object and the second virtual object represent attainment of objectives in the first group game and the second group game;

calculating that a first odds of occurrence of a second wagering game event for the second virtual object is equivalent to a second odds of occurrence of the first wagering game event; and exchanging the first virtual object of the first group game as a substitute for the second virtual object of the second group game, in response to calculating that the first odds of occurrence is equivalent to the second odds of occurrence.

* * * * *